US007051805B2

(12) United States Patent
Doane et al.

(10) Patent No.: US 7,051,805 B2
(45) Date of Patent: May 30, 2006

(54) EXPANDABLE PACKER WITH ANCHORING FEATURE

(75) Inventors: James C. Doane, Friendswood, TX (US); Jason M. Harper, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 155 days.

(21) Appl. No.: 10/301,229

(22) Filed: Nov. 21, 2002

(65) Prior Publication Data

US 2003/0141079 A1 Jul. 31, 2003

Related U.S. Application Data

(63) Continuation-in-part of application No. 10/117,521, filed on Apr. 5, 2002.

(60) Provisional application No. 60/344,314, filed on Dec. 20, 2001.

(51) Int. Cl.
*E21B 33/12* (2006.01)

(52) U.S. Cl. ..... 166/120; 166/134; 166/206; 166/387

(58) Field of Classification Search ..... 166/382, 166/387, 206, 207, 120, 134
See application file for complete search history.

(56) References Cited

U.S. PATENT DOCUMENTS

| | | | |
|---|---|---|---|
| 2,159,640 | A | 5/1939 | Strom |
| 2,652,894 | A | 9/1953 | Brown et al. |
| 3,097,696 | A | 7/1963 | Orr |
| 3,272,517 | A | 9/1966 | Howard et al. |
| 3,298,440 | A | 1/1967 | Current |
| 3,776,307 | A | 12/1973 | Young |
| 3,910,348 | A | 10/1975 | Pitts |
| 4,069,573 | A | 1/1978 | Rogers, Jr. et al. |
| 4,749,035 | A | 6/1988 | Cassity |
| 4,784,226 | A | 11/1988 | Wyatt |
| 4,817,716 | A | 4/1989 | Taylor et al. |
| 4,832,125 | A | 5/1989 | Taylor |
| 4,862,957 | A | 9/1989 | Scranton |
| 5,069,280 | A | 12/1991 | McKee et al. |
| 5,197,542 | A | 3/1993 | Coone |
| 5,220,959 | A | 6/1993 | Vance, Sr. |
| 5,348,095 | A | 9/1994 | Worrall et al. |

(Continued)

FOREIGN PATENT DOCUMENTS

WO WO 00/58601 10/2000

OTHER PUBLICATIONS

Brochure from Owens Tools website, "X–Span Systems", CoreLab Downhole Solutions, Dec. 18, 2001, 6 pages.
Dreesen, D.S., SPE 22858, "Analytical and Experimental Evaluation of Expanded Metal Packers for Well Completion Service", Oct. 6, 1991, pp. 413–421.

*Primary Examiner*—Hoang Dang
(74) *Attorney, Agent, or Firm*—Steve Rosenblatt

(57) ABSTRACT

An expandable packer or anchor is disclosed. It features a gripping device integral to or mounted in a sleeve over the mandrel and mating undulating surfaces to help maintain grip under changing load conditions. Upon expansion, pressure on a sealing element is enhanced by nodes to increase internal pressure as it engages an outer tubular. Adjacent retaining rings limit extrusion and enhance grip. A gripping device, such as wickers on slips, preferably digs into the outer tubular. The expansion is preferably by pressure and can incorporate pressure intensifiers delivered by slick line or wire line. Release is accomplished by a release tool, which is delivered on slick line or wire line. It stretches the anchor or packer longitudinally, getting it to retract radially, for release. The release tool can be combined with packers or anchors that have a thin walled feature in the mandrel, to release by pulling the mandrel apart.

24 Claims, 36 Drawing Sheets

U.S. PATENT DOCUMENTS 5,366,012 A 11/1994 Lohbeck
5,542,473 A 8/1996 Pringle
5,667,011 A 9/1997 Gill et al.
5,720,343 A 2/1998 Kilgore et al.
6,073,692 A 6/2000 Wood et al.
6,098,717 A 8/2000 Bailey et al.
6,213,204 B1 4/2001 Doane
6,325,148 B1 12/2001 Trahan et al.
6,446,717 B1 9/2002 White et al.
6,513,600 B1 2/2003 Ross
6,527,049 B1 3/2003 Metcalfe et al.
6,591,905 B1 7/2003 Coon
6,598,678 B1 7/2003 Simpson et al.
6,691,789 B1 * 2/2004 Jackson et al. ..... 166/384
6,702,029 B1 * 3/2004 Metcalfe et al. ..... 166/378
2002/0014339 A1 2/2002 Ross
2003/0042028 A1 3/2003 Lauritzen et al.
2003/0047320 A1 3/2003 Badrak et al.
2003/0047322 A1 3/2003 Maguire et al.
2003/0062171 A1 4/2003 Maguire et al.
2003/0205386 A1 * 11/2003 Johnston et al. ..... 166/382
2003/0217844 A1 11/2003 Moyes

* cited by examiner

EXPANDABLE PACKER WITH ANCHORING FEATURE

PRIORITY INFORMATION

This application is a continuation-in-part of prior U.S. application Ser. No. 10/117,521, filed on Apr. 5, 2002, which claims the benefit of U.S. Provisional Application No. 60/344,314 filed on Dec. 20, 2001.

FIELD OF THE INVENTION

The field of this invention relates to packers and more particularly to packers that can be set by expansion and more particularly incorporating an anchoring feature to engage the surrounding tubular upon physical expansion of the packer.

BACKGROUND OF THE INVENTION

Traditional packers comprised of a sealing element having anti-extrusion rings on both upper and lower ends and a series of slips above or/and below the sealing element. Typically a setting tool would be run with the packer to set it. The setting could be accomplished hydraulically due to relative movement created by the setting tool when subjected to applied pressure. This relative movement would cause the slips to ride up cones and extend into the surrounding tubular. At the same time, the sealing element would be compressed into sealing contact with the surrounding tubular. The set could be held by a body lock ring, which would prevent reversal of the relative movement, which caused the packer to set in the first instance.

As an alternative to pressure through the tubing to the setting tool to cause the packer to set, another alternative was to run the packer in on wire line with a known electrically operated setting tool such as an E-4 made by Baker Oil Tools. In this application, a signal fires the E-4 causing the requisite relative movement for setting the packer. Some of these designs were retrievable. A retrieving tool could be run into the set packer and release the grip of the lock ring so as to allow a stretching out of the slips back down their respective cone and for the sealing element to expand longitudinally while contracting radially so that the packer could be removed from the well.

In the past, sealing has been suggested between an inner and an outer tubular with a seal material in between. That technique, illustrated in U.S. Pat. No. 6,098,717, required the outer tubular or casing to be expanded elastically and the inner tubular to be expanded plastically. The sealing force arose from the elastic recovery of the casing being greater than the elastic recovery of the inner tubular, thus putting a net compressive force on the inner tubular and the seal. Other expansion techniques, described in U.S. Pat. Nos. 5,348,095; 5,366,012; and 5,667,011 simply related to expansion of slotted tubulars, serving as a liner in open hole, as a completion technique. U.S. Pat. No. 4,069,573 illustrates the use of expansion to form a tubular casing patch.

The present invention relates to construction features and methods of employing packers that can be expanded into sealing position. The surrounding tubular does not need to be expanded to set the packer of the present invention. Rather, an anchor such as slips is used to support the expanded sealing element and hold it in a set position. Preferably, existing setting tools, with minor modifications can be used to expand the packer of the present invention. Similarly releasing tools can be employed to remove the packer from its set position. The running string can be exposed to lower pressures than the packer through the use of pressure intensifiers. The expansion force can be pinpointed to the area of the packer, thus avoiding subjecting the formation or the running string to undue pressures during setting of the packer. Alternatively, the inner tubular may simply be an anchor for another tool or a liner string. The anchoring can be ridges on the exterior of the inner tubing directly or on a ring mounted over the inner tubular being expanded. The ring can be slotted to reduce the required expansion force. The slips are retained to the mandrel by undulating mating surfaces. The grip area is enlarged to reduce stress on the tubular. Features are included to help hold the set on shifting load conditions and to augment the applied force on the sealing element. A variety of potential applications are illustrated.

The setting tool can be delivered through tubing on slick line or wire line or run into the well on rigid or coiled tubing or wire line, among other techniques. The release tool can be likewise delivered and when actuated, stretches the packer or anchor out so that it can be removed from the wellbore. Conventional packers, that have their set held by lock rings, can be released with the present invention, by literally pushing the body apart as opposed to cutting it downhole as illustrated in U.S. Pat. No. 5,720,343.

These and other advantages of the present invention will be more readily understood from a review of the description of the preferred embodiment, which appears below.

SUMMARY OF THE INVENTION

An expandable packer or anchor is disclosed. It features a gripping device integral to or mounted in a sleeve over the mandrel and mating undulating surfaces to help maintain grip under changing load conditions. Upon expansion, pressure on a sealing element is enhanced by nodes to increase internal pressure as it engages an outer tubular. Adjacent retaining rings limit extrusion and enhance grip. A gripping device, such as wickers on slips, preferably digs into the outer tubular. The expansion is preferably by pressure and can incorporate pressure intensifiers delivered by slick line or wire line. Release is accomplished by a release tool, which is delivered on slick line or wire line. It stretches the anchor or packer longitudinally, getting it to retract radially, for release. The release tool can be combined with packers or anchors that have a thin walled feature in the mandrel, to release by pulling the mandrel apart.

DETAILED DESCRIPTION OF THE PREFERRED EMBODIMENT

Figure 1:
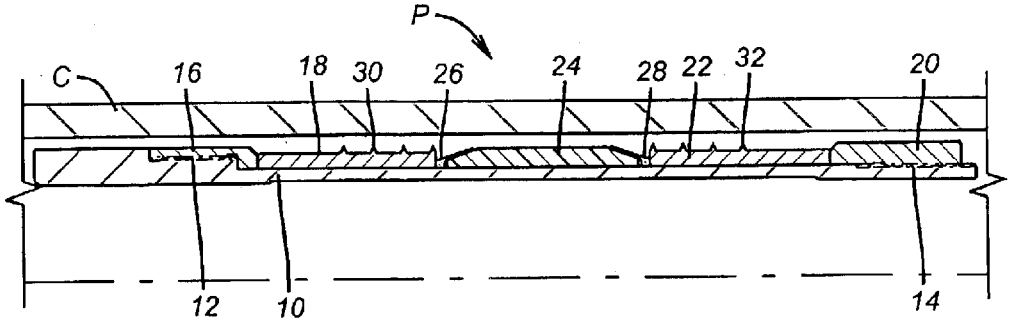
FIG. 1 is a section through the packer of the present invention in the run in position.
Figure 2:
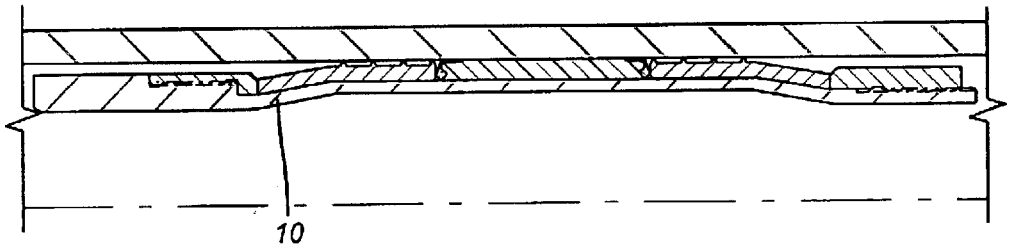
FIG. 2 is the view of FIG. 1 with the packer in the set position.
Figure 3:
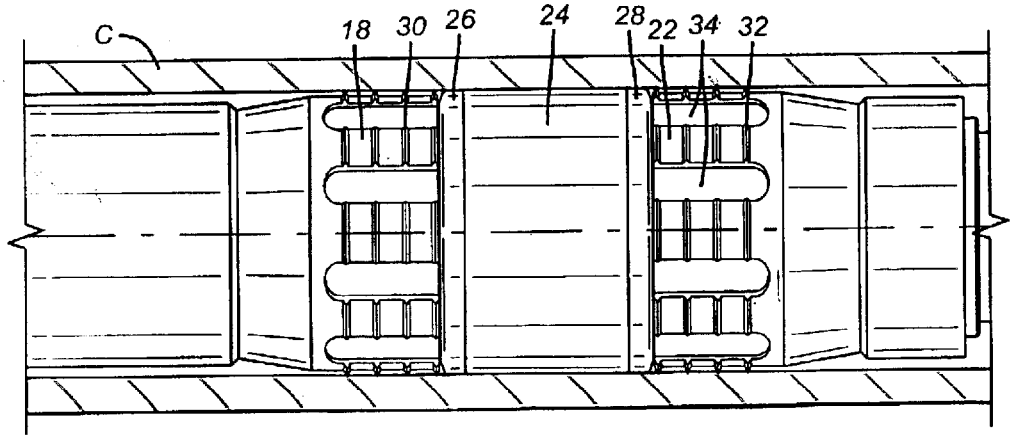
FIG. 3 is an outside view of the packer showing the slips on a ring with recesses.
Figure 4A:
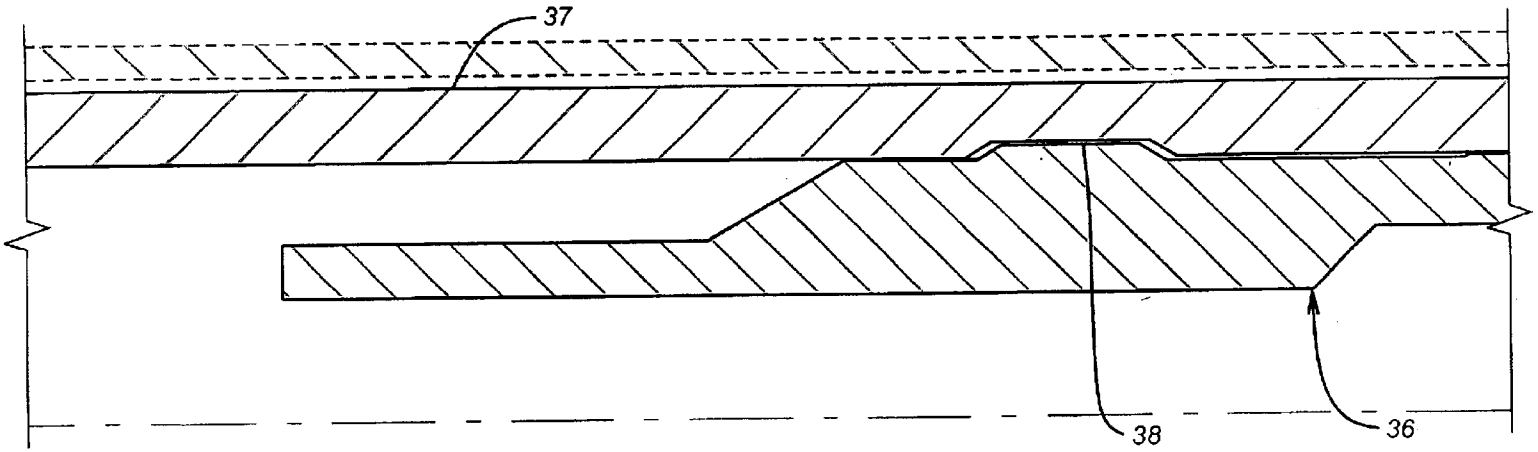
FIGS. 4*a*–4*d* show the packer schematically prior to expansion using a pressure intensifier.
Figure 5A:
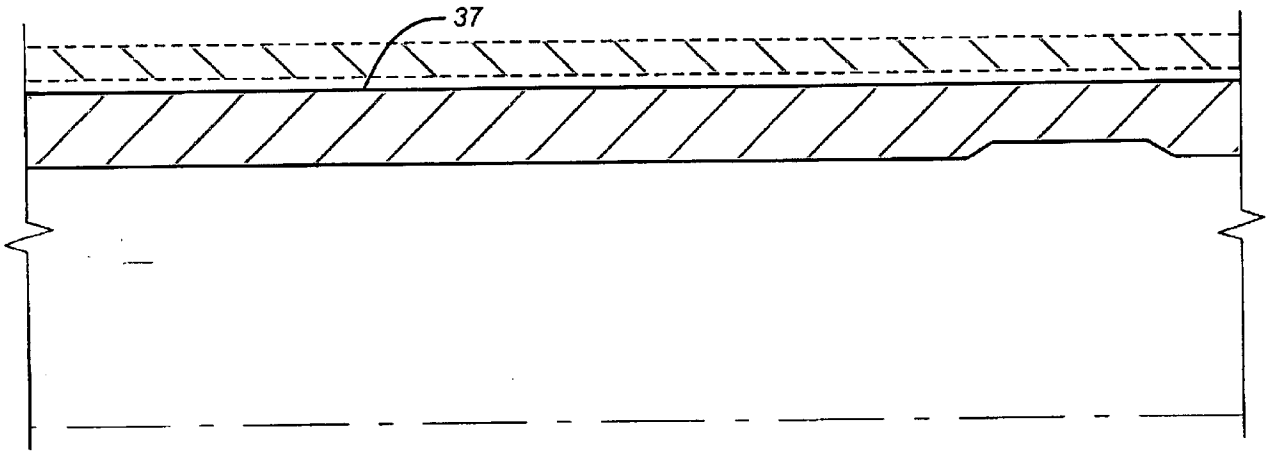
FIGS. 5*a*–5*d* show the packer of FIGS. 4*a*–4*d* in the set position with the through tubing pressure intensifier removed.
Figure 4B:
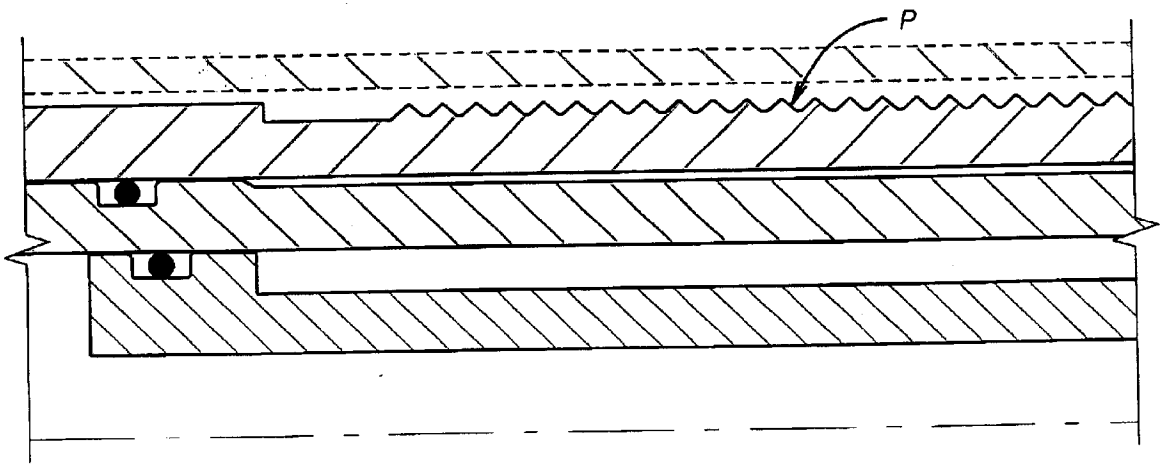
Figure 5B:
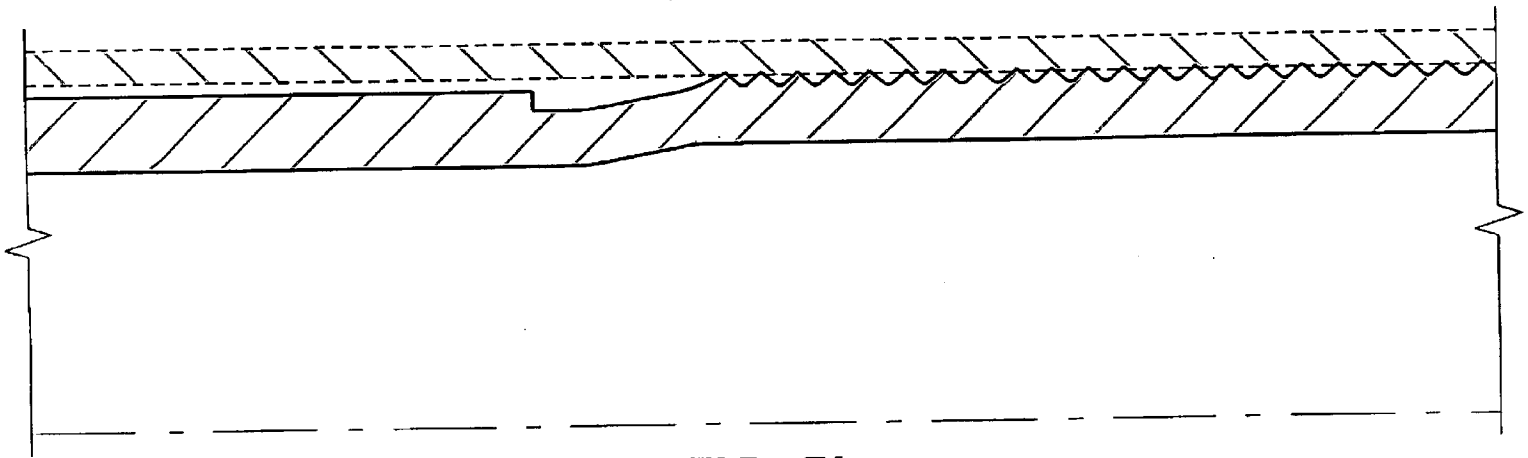
Figure 4C:
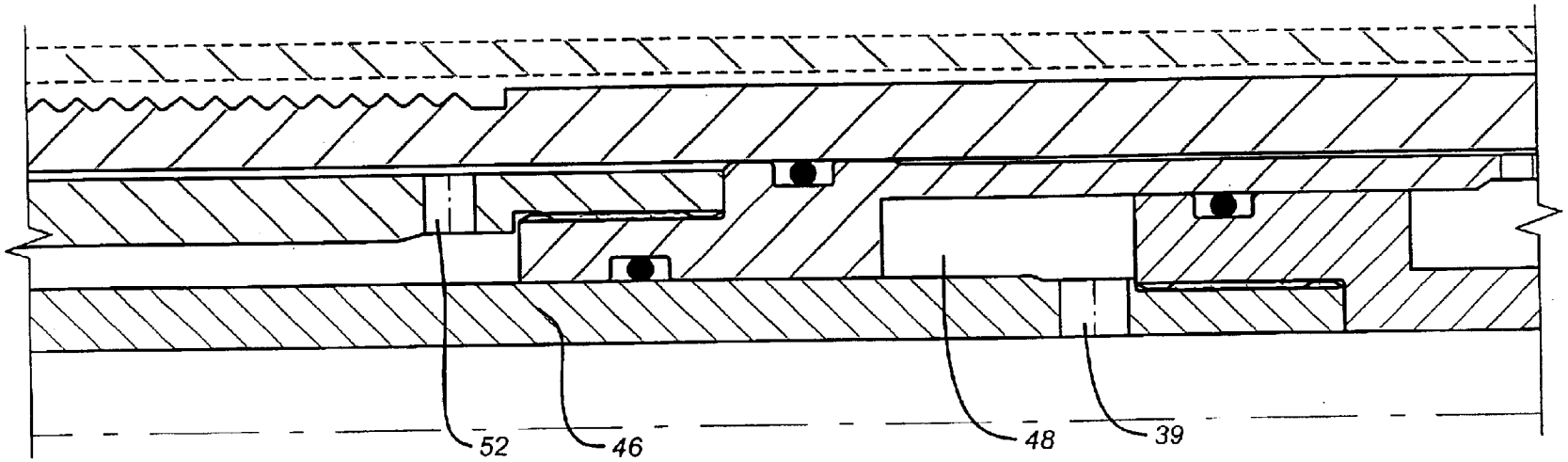
Figure 5C:
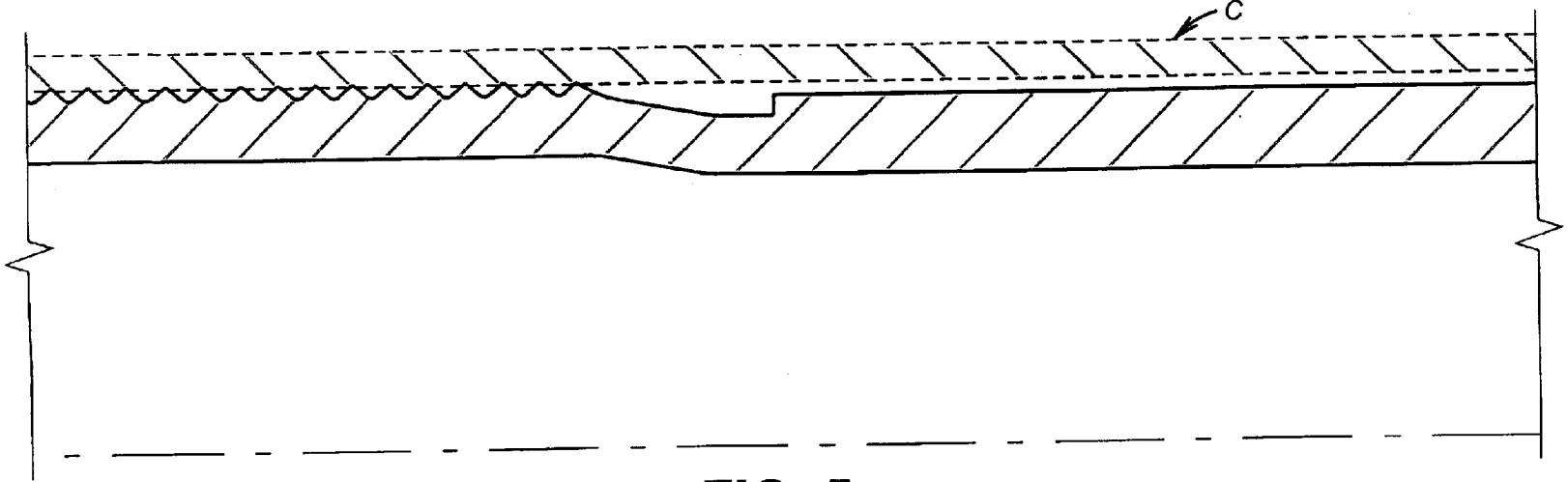
Figure 4D:
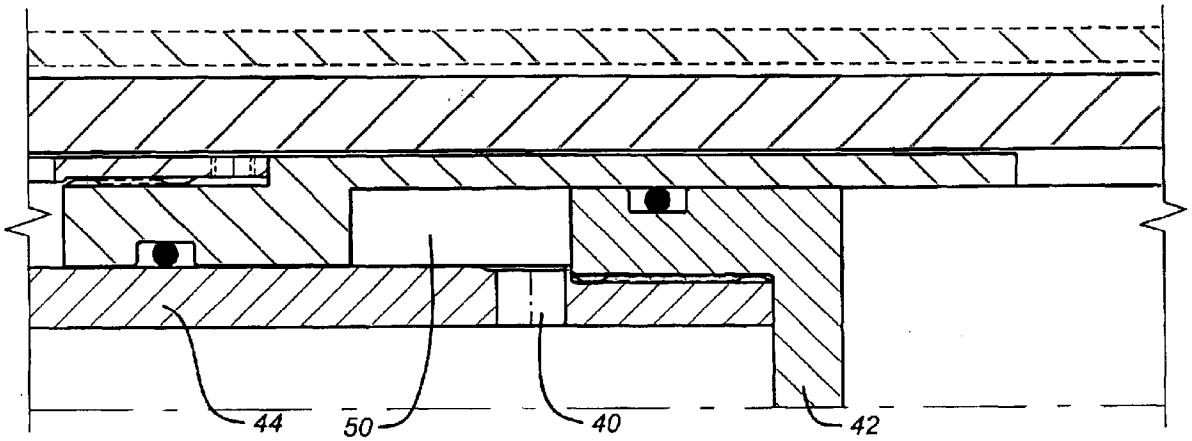
Figure 5D:
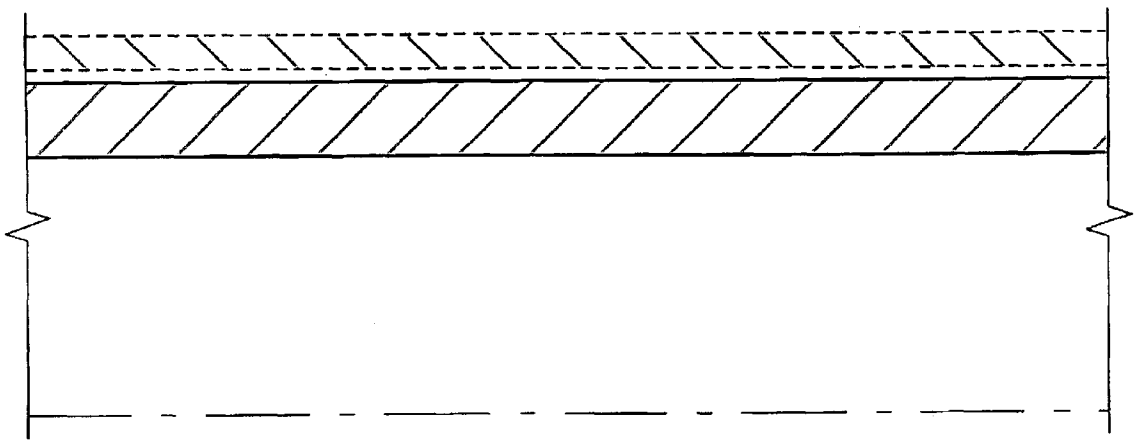

Referring to FIG. 1, the packer P has a mandrel 10 with an upper thread 12 and a lower thread 14. Upper slip ring 16 attaches at thread 12 and has extending slips 18. As shown in FIG. 3, slips 18 are fingers of preferably metal separated by slots 34. One purpose of the slots 34 is to decrease resistance to expansion. Another is to allow the wickers 32 to be hardened. If the slips were to be continuous and have hardened wickers 32, the brittleness would cause the slips to crack on expansion. Lower slip ring 20 attaches at thread 14 and has finger like slips 22 extending from it. Slips 18 and 22 each have wickers or some other surface sharpness 32 designed to dig in for a supporting bite into the casing C upon expansion of the mandrel 10. A sealing element 24 having backup rings 26 and 28 is disposed between slips 18 and 22. Those skilled in the art will appreciate that the slips 18 and 22 can be formed as an integral part of the mandrel, thus eliminating the threads 12 and 14 as well as the rings 16 and 20. In that event, the slips 18 and 22 can be a series of finger shaped protrusions from the outer surface of the mandrel 10. These protrusions can be integral, welded, or attached in some other way. Although a packer has been described, the sealing element 24 can be eliminated and the slips 18 and 22, regardless of how they are attached, can be used to anchor a tubing string (not shown) or a tool (not shown) attached to the mandrel 10, when the wickers 32 dig into the surrounding casing C. Conceivably, the expansion of the wickers 32 into the casing or outer tubular C can accomplish not only a support function but also a sealing function. Sealing is possible without having to appreciably expand the casing C or even without expanding the casing C at all. The invention can be effective with a single or multiple rings of slips, regardless of their attachment mode, and with a variety of known designs for the sealing element 24.

The clear advantage of the present invention is that cones are not required to drive the slips outwardly. This means that for a given outside diameter for run in, the packer or anchor P of FIG. 1 will have a larger internal bore diameter than a design relying on cones to ramp slips out. The larger bore possible in the mandrel 10 comes with no significant reduction of the pressure rating of the packer P.

The wickers 30 and 32 are preferably hardened to facilitate penetration into the casing. The sealing element 24 is preferably Nitrile but can also be made from other materials such as Teflon or PEEK. The backup rings 26 and 28 are preferably ductile steel and serve the function of keeping the sealing element 24 out of the slots 34 between the slips 18 and 22. Rather than slots 34 to facilitate expansion of the slips 18 and 22, the sleeve that holds the slips can be made thinner or have other openings, such as holes, to reduce its resistance to expansion. The expansion itself can be carried out with known expansion tools such as roller expanders, swages, or cones. Alternatively, an inflatable can be used to expand the mandrel 10 or a pressure technique, as illustrated in 4*a*–4*d*, 5*a*–5*d*, 12*a*–12*e*, and 13*a*–13*e*.

FIGS. 4*a*–4*d* illustrate a thru-tubing approach to setting where either a slick line or a wire line can be used to deliver a pressure intensifier 36 to a desired position where it will latch in the tubing 37 adjacent the packer or anchor P. The packer or anchor P is illustrated schematically as is the connection at the top of the intensifier 36. Pressure applied into tubing 37 enters ports 39 and 40. Pistons 42, 44, and 46 are connected together for tandem movement. Pressure from ports 39 and 40 enters cavities 48 and 50 to apply downward forces on pistons 42, 44, and 46. Additional pistons can be used for greater force amplification. The use of intensifier 36 allows a lower pressure to be used at the wellhead in case it has a low pressure rating and the expansion force desired at the packer or anchor P exceeds the rated wellhead pressure. Downhole movement of piston 46 forces fluid out of port 52 to expand the packer or anchor P. The intensifier 36 is retrieved after expansion with a known fishing tool, which engages a fishing neck in the top of the intensifier. As shown in FIGS. 5*a*–5*d*, the packer or anchor P is set against tubular or casing C and the intensifier is removed from the tubing 37.

Figure 12A:
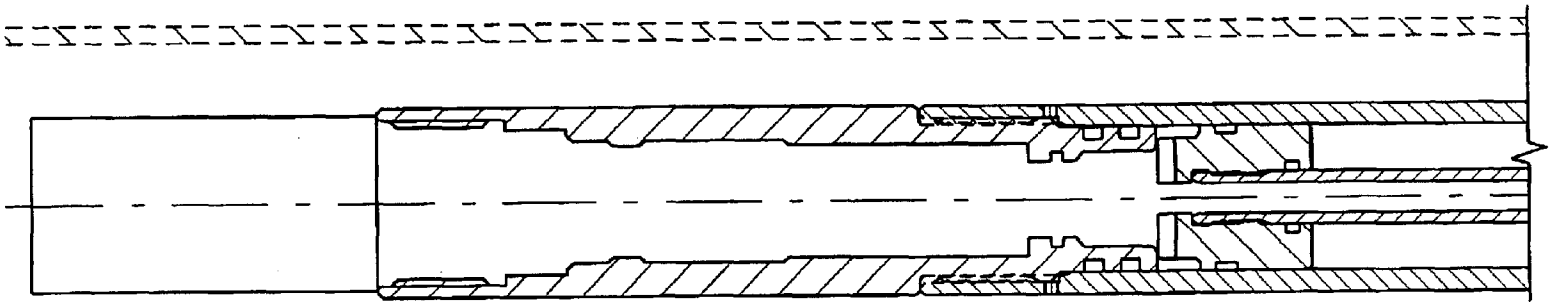
FIGS. 12*a*–12*e* show the packer run in with a wire line or hydraulic setting tool in the run in position.
Figure 12B:
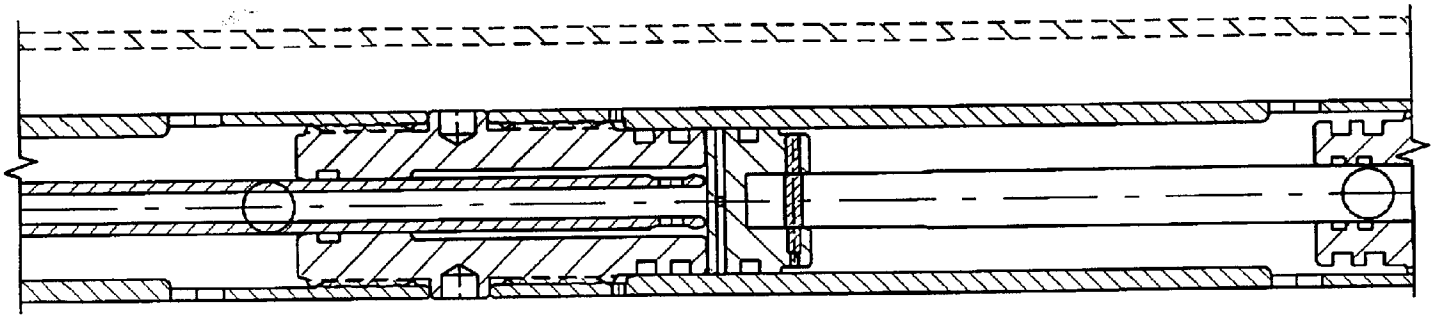
Figure 12C:
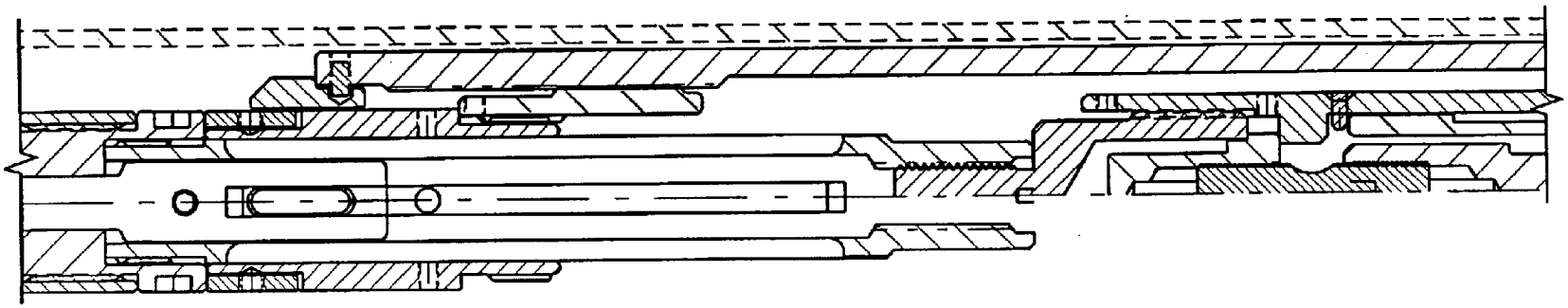
Figure 12D:
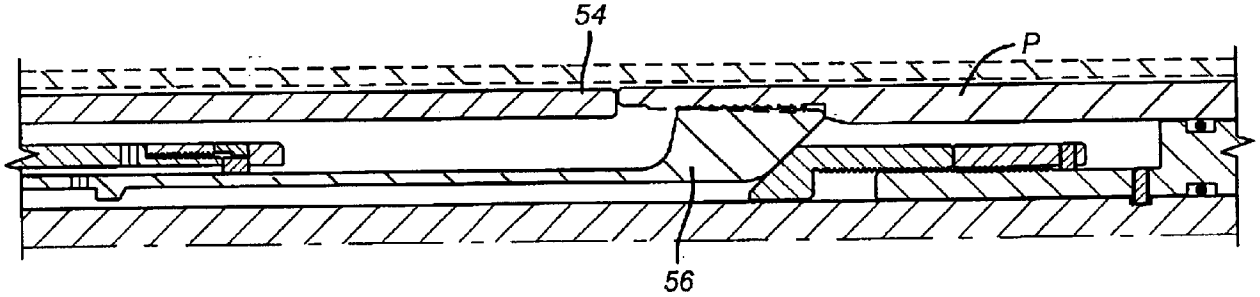
Figure 13D:
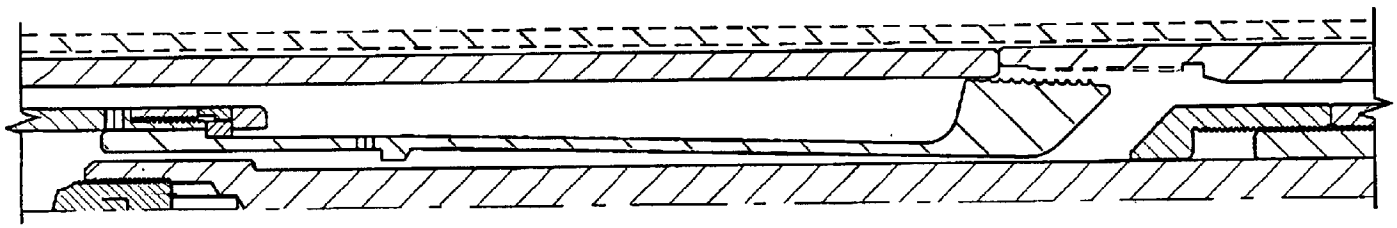
Figure 12E:
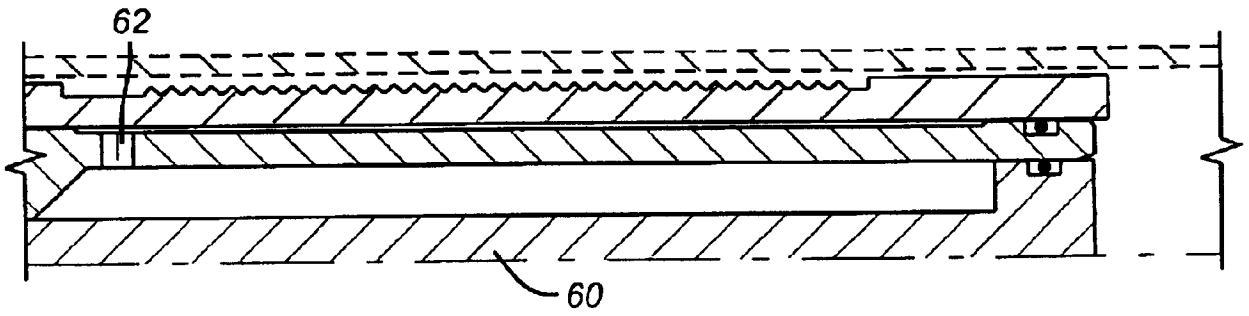
Figure 13E:
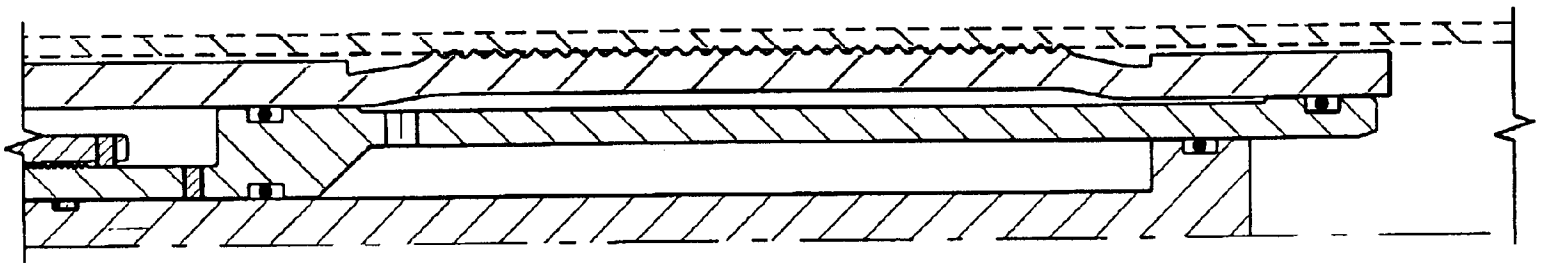

Another way to deliver and set the packer or anchor P is shown in FIGS. 12*a*–12*e* and 13*a*–13*e*. In these figures the packer or anchor P is delivered on a hydraulic or wire line setting tool, as opposed to the through-tubing techniques previously described. The setting tool is schematically illustrated to cover the use of both hydraulic or wire line setting. A sleeve 54 abuts the top of the packer or anchor P (FIG. 12*d*). A gripping sleeve 56 retains the packer or anchor P until the shear stud 58 fails. Circulation is possible when using the hydraulic setting tool until an object is dropped to allow pressure buildup to ultimately move piston 60 to set the packer or anchor P. Upward movement of the piston 60 breaks the shear stud 58 after delivering the required pressure for expansion through port 62 to the packer or anchor P. The hydraulic setting tool can incorporate pressure intensifiers so as to limit the surface pressure applied to get the desired expansion, in the event the wellhead has a low pressure rating. Breaking the shear stud 58 allows removal of the setting tool and a subsequent tagging the packer with production tubing. The pressure intensifier can have more or fewer pistons to get the desired pressure amplification. Hydrostatic pressure can be employed to do the expanding instead of or in conjunction with surface applied pressure. Various ways can be used to connect the tubing to the packer. The expansion tool can be released from the packer by rotation. Known setting tools can be employed such as those made by Baker Oil Tools under model numbers BH, BHH, B-2 and J with only slight adaptations.

In a wire line variation, the setting tool would be electrically actuated to set off an explosive charge to create the needed pressure for expansion of the packer or anchor P in the manner previously described with the possibility of integrating a pressure intensifier. Once the packer or anchor P is expanded, an automatic release from the setting tool occurs so that it could be removed. Known wire line setting tools like the E-4 made by Baker Oil Tools can be used, or others. The expansion concept is the same, stroking a piston with a pressure source and, if necessary a pressure intensifier, creates the pressure for expansion of the packer or anchor P to expand it into position against the tubular or casing C and to trigger an automatic release for retrieval of the settling tool. After the setting tool is pulled out, tubing is tagged into the expanded packer or anchor.

Figure 6A:
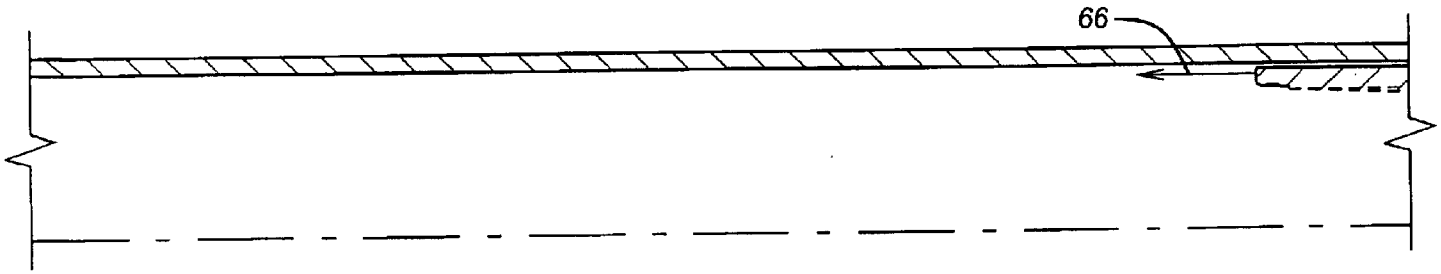
FIGS. 6*a*–6*b* show schematically how force is to be applied to release the packer.
Figure 7A:
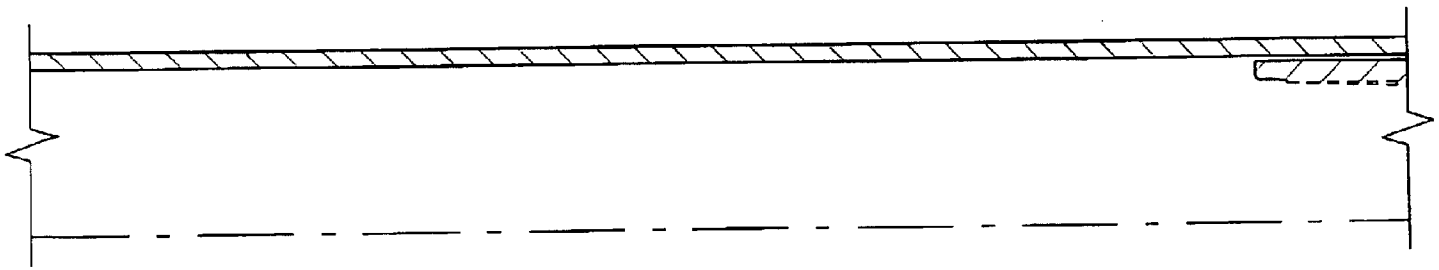
FIGS. 7*a*–7*b* show the released position of the packer after applying the forces shown in FIGS. 6*a*–6*b;*
Figure 6B:
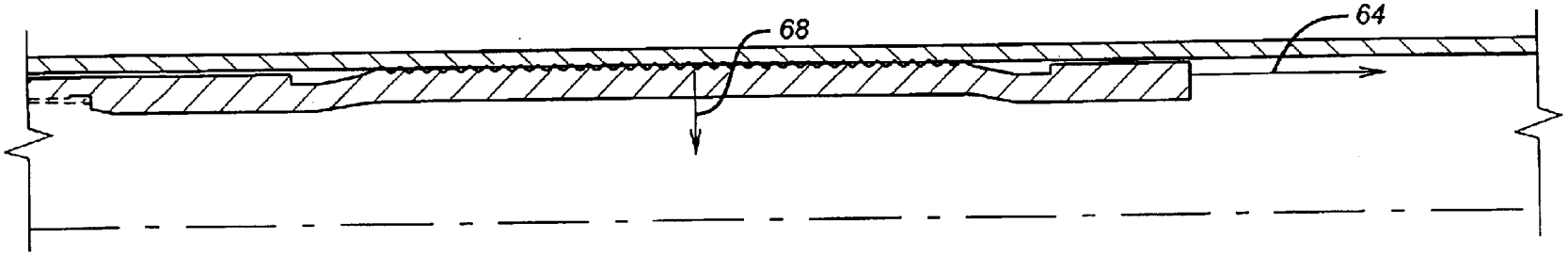
Figure 7B:
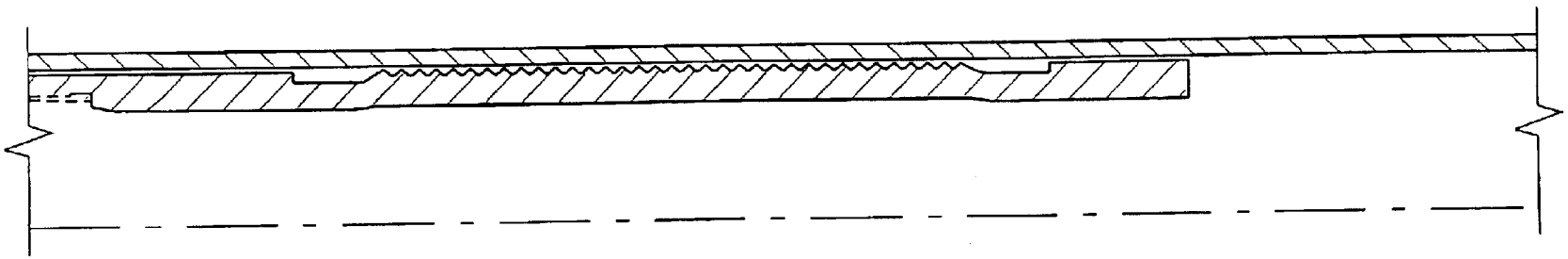

Release of the packer or anchor P is schematically illustrated in FIGS. 6*a*–6*b*. The technique is longitudinal extension as illustrated by opposed arrows 64 and 66. This longitudinal extension results in radial contraction, shown schematically as arrow 68. What actually occurs is that the wickers 30 and 32 (shown in FIG. 1), which had dug into the casing C on expansion, are pulled or sheared out of the casing. The longitudinal extension also draws back the sealing element 24 as the mandrel under it radially contracts. FIGS. 7*a*–7*b* show the released position.

Figure 8A:
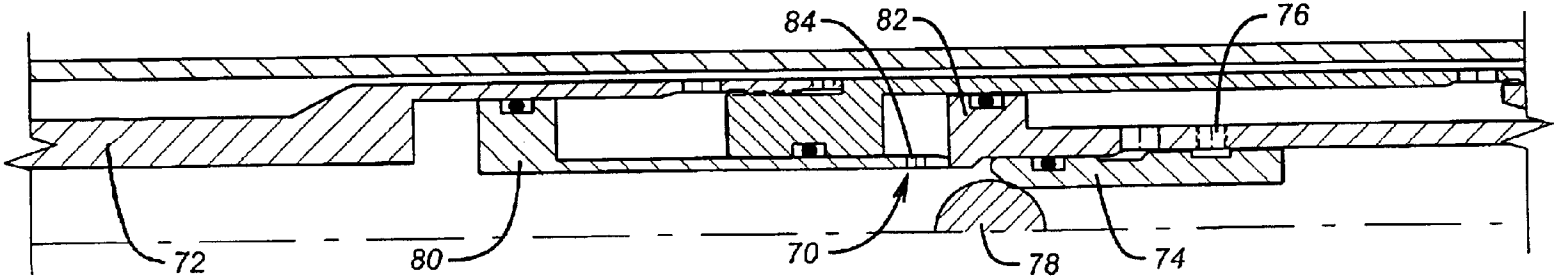
FIGS. 8*a*–8*b* show one version of a release tool for the packer where the release tool is tubing delivered to latch to the top of the packer.
Figure 8B:
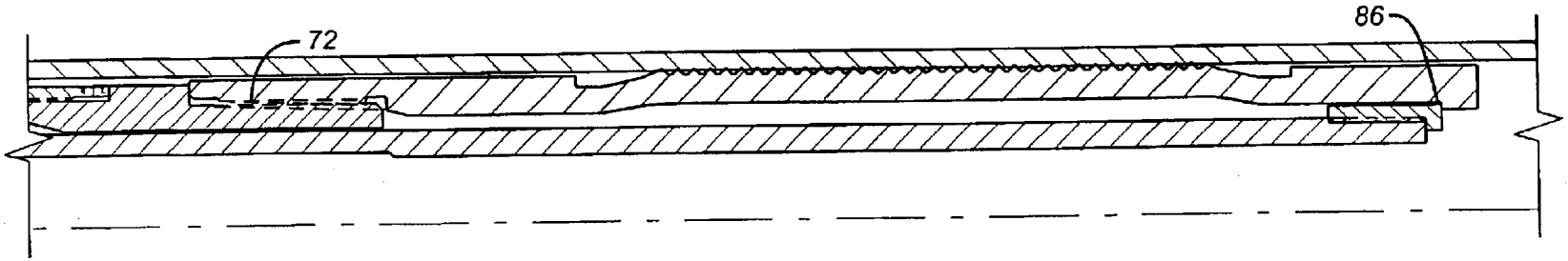

One way to accomplish the release as described above is shown in FIGS. 8*a*–8*b*. The release tool 70 is run into the well after the production tubing is pulled. It is secured downhole to the packer at connection 72, which can be a variety of configurations. A ball seat 74 is retained by shear pins 76 and accepts a ball 78 dropped from the surface. Built up pressure pushes down of piston 80 and piston 82 through port 84. Piston 80 bears down on piston 82. Piston 82 bears on shoulder 86 on the packer or anchor P. Thus the packer or anchor P is subjected to a longitudinal extension from an uphole force at connection 72 and a downhole force at shoulder 86. The resulting radial retraction allows removal of the packer or anchor P with the tubing 72.

Figure 9A:
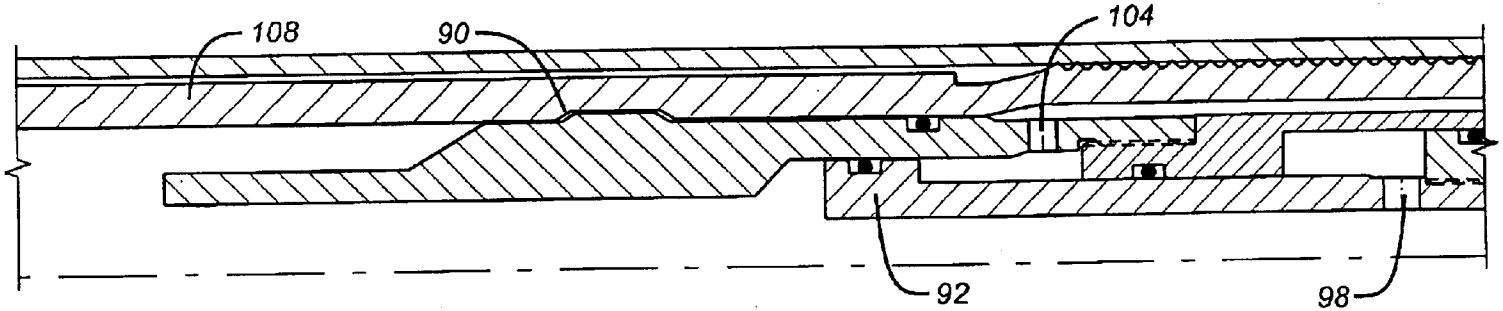
FIGS. 9*a*–9*b* show a through tubing release tool, which can be delivered on wire line or slick line.
Figure 9B:
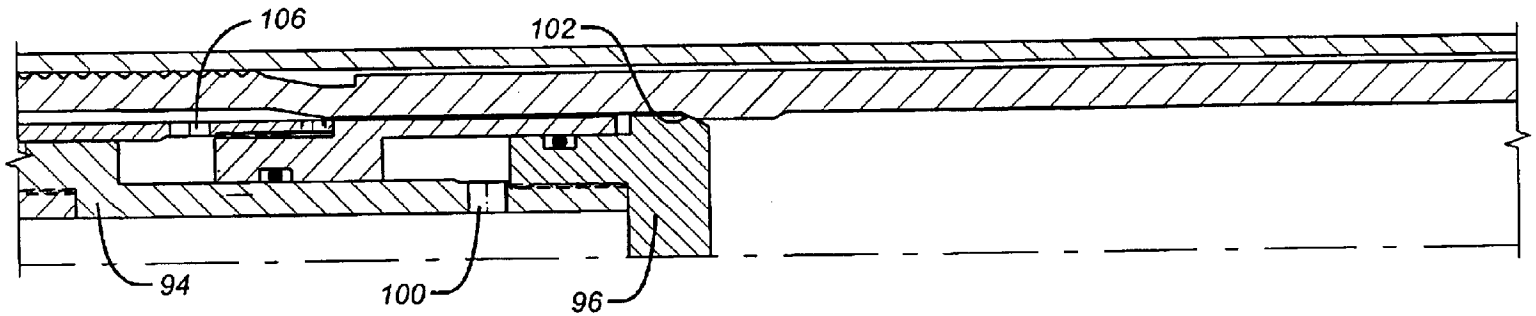
Figure 10A:
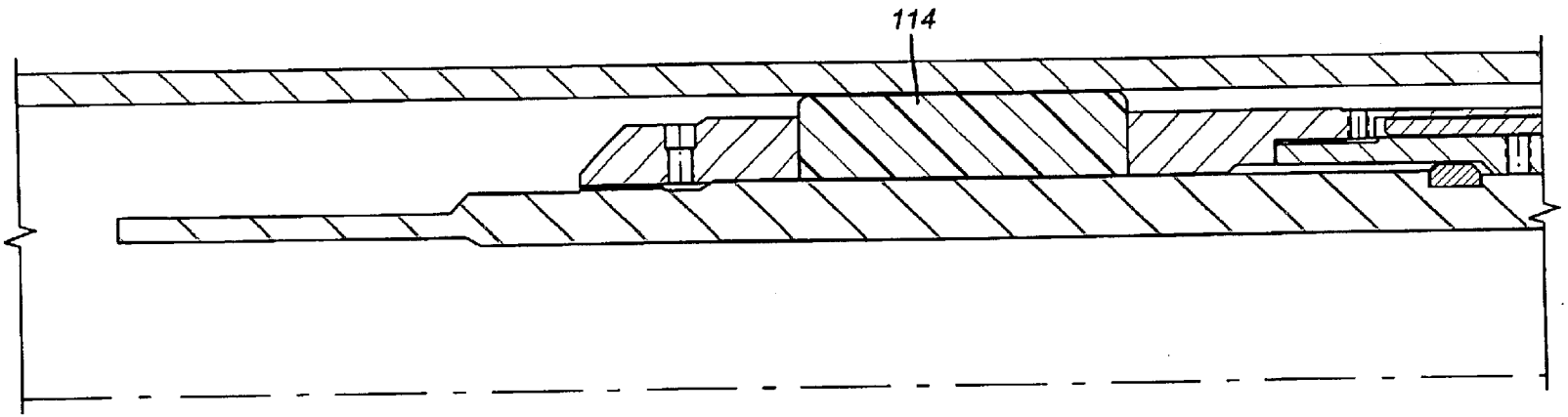
FIGS. 10*a*–10*d* show a packer with a mandrel having a thin wall segment with a release tool inserted through tubing and the packer in the set position.
Figure 10B:
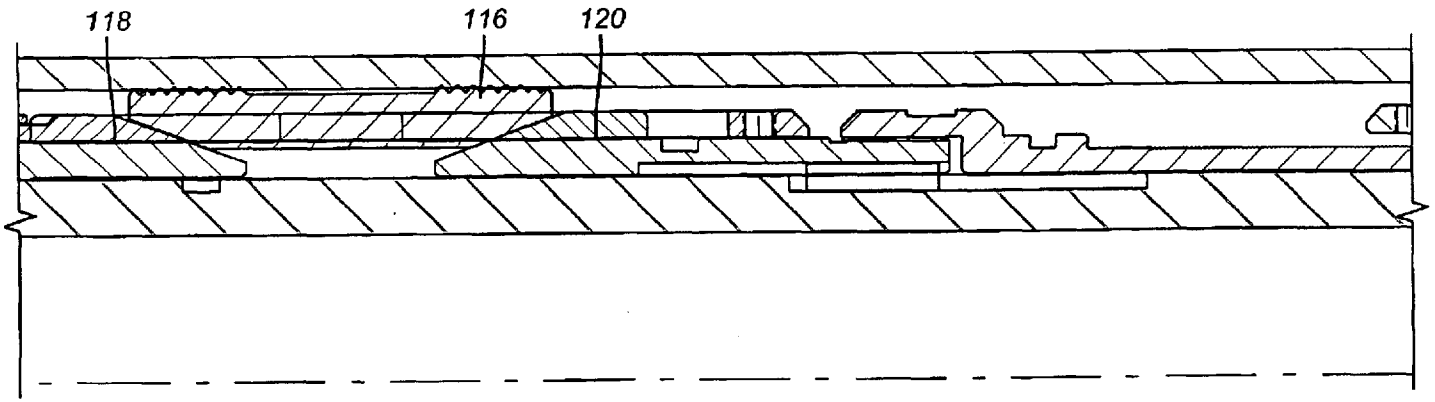
Figure 10C:
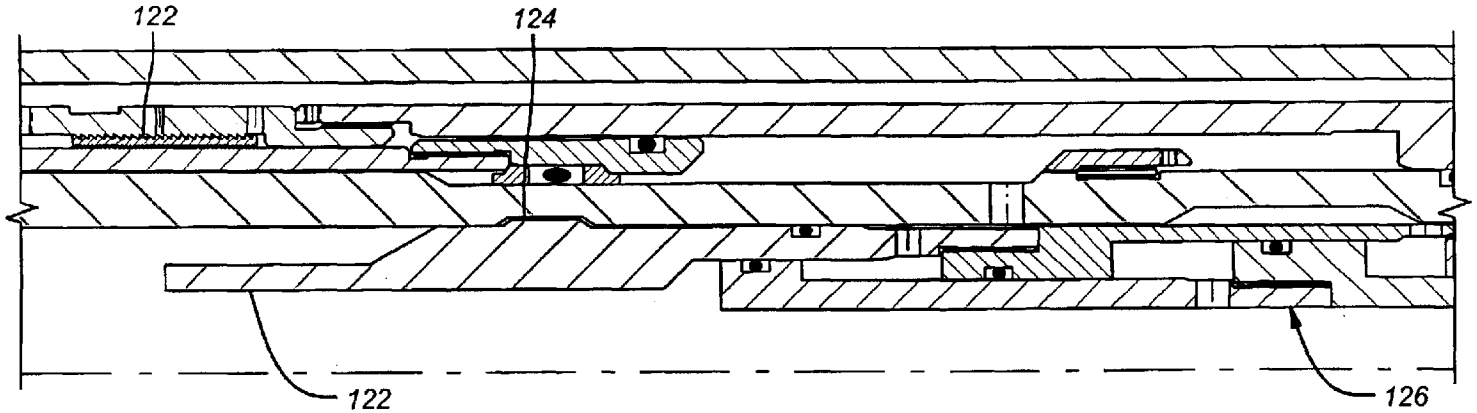
Figure 10D:
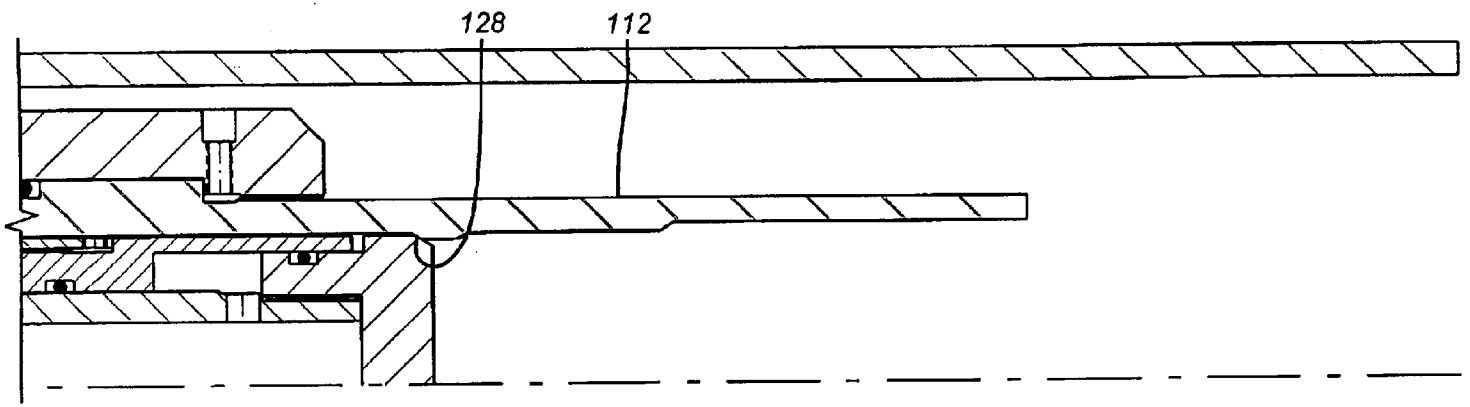

FIGS. 9*a*–9*b* show a thru-tubing variation of the release technique. The release tool 88 can be run in on slick line or wire line to latch into latch 90. Pressure is developed on pistons 92, 94, and 96. Ports 98 and 100 allow access to pistons 94 and 96 respectively. Piston 92 bears on piston 94, which in turn bears on piston 96. Piston 96 rests on shoulder 102 on the anchor or packer P while the other end of the release tool 88 is latched at latch 90. Ports 104 and 106 allow pistons 92 and 94, respectively to move by allowing fluid to pass. Accordingly, applied pressure in tubing 108 or generated pressure from an electric line setting tool such as an E-4 made by Baker Oil Tools, stretches the packer or anchor P to get the slips 18 and 22 (see FIG. 1) to let go of their grip of the tubular or casing C in the manner previously described.

Figure 11A:
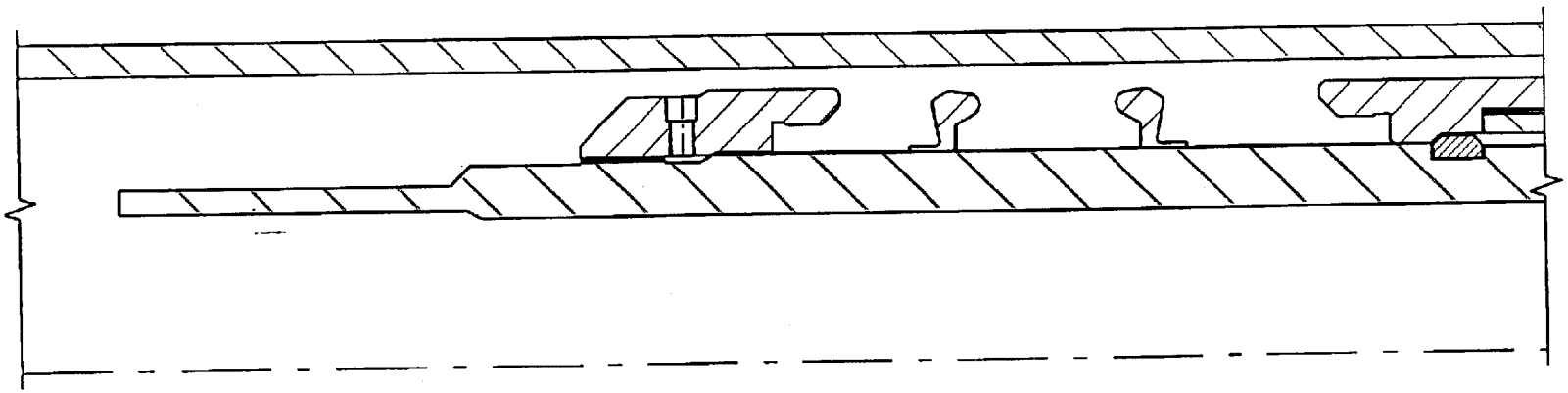
FIGS. 11*a*–11*d* show the packer of FIGS. 10*a*–10*d* in the released position.
Figure 11B:
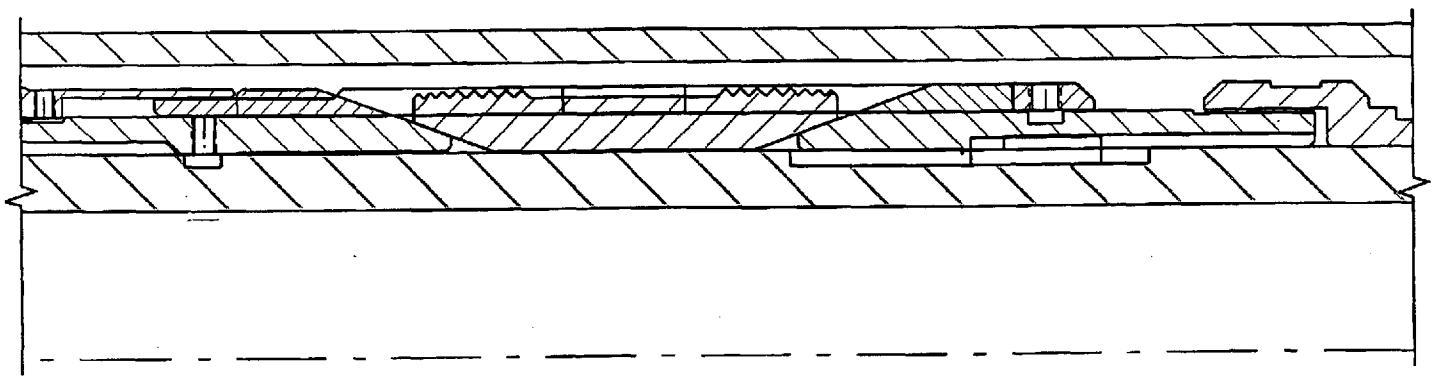
Figure 11C:
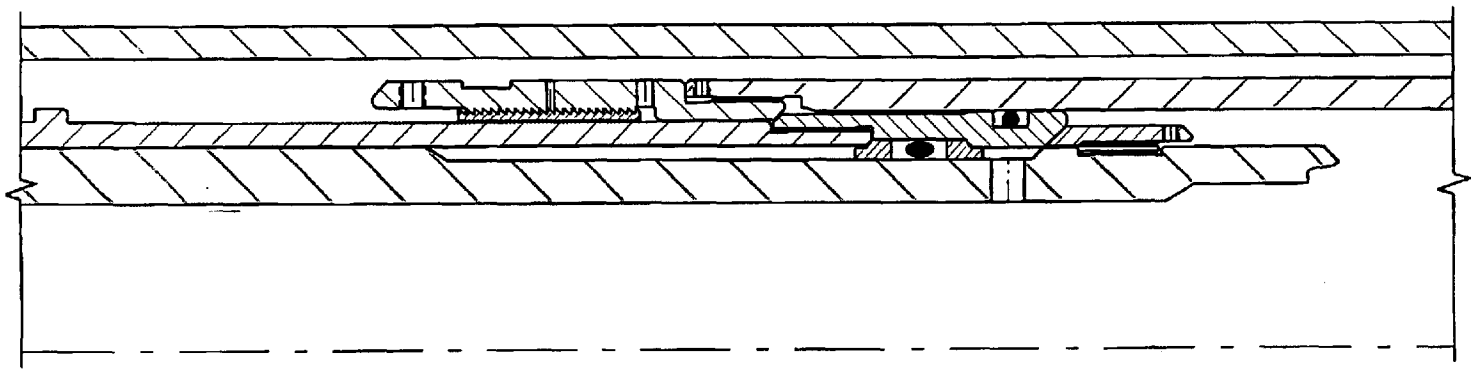
Figure 11D:
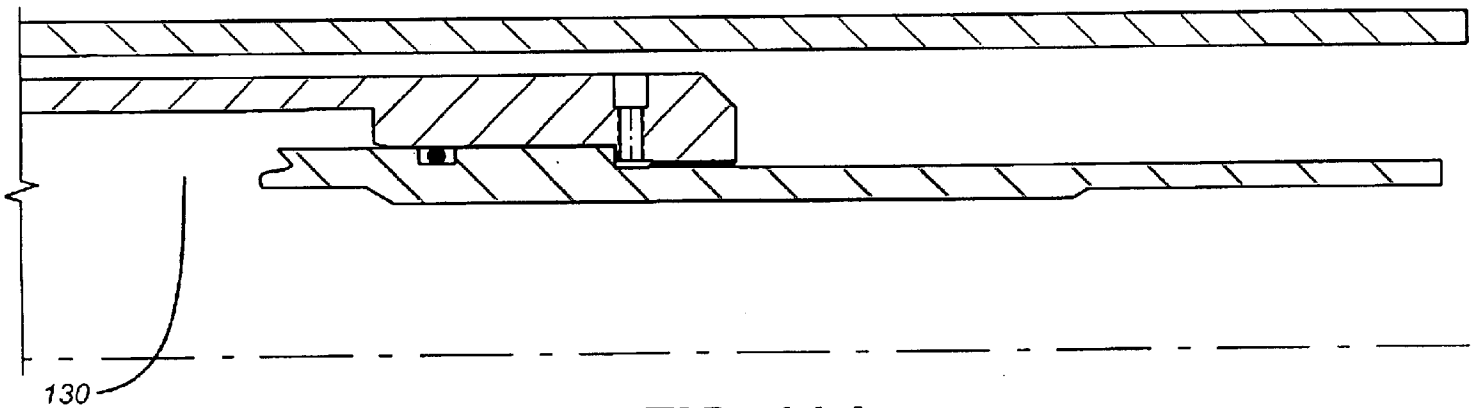
Figure 13A:
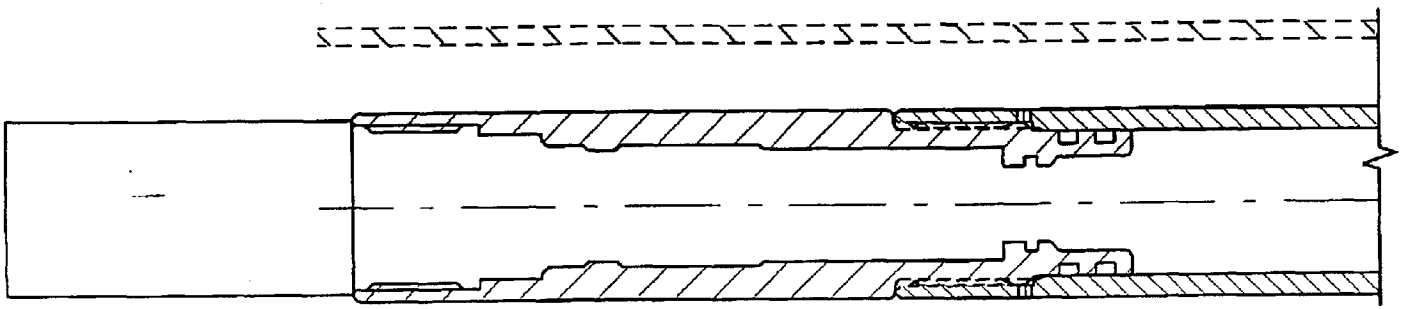
FIGS. 13*a*–13*e* show the packer of FIGS. 12*a*–12*e* in the set position with the setting tool released.
Figure 13B:
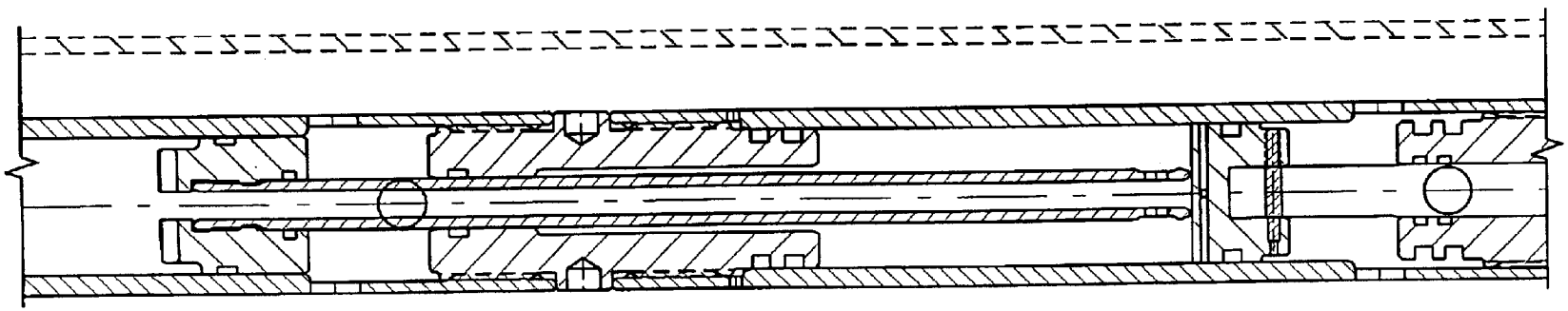
Figure 13C:
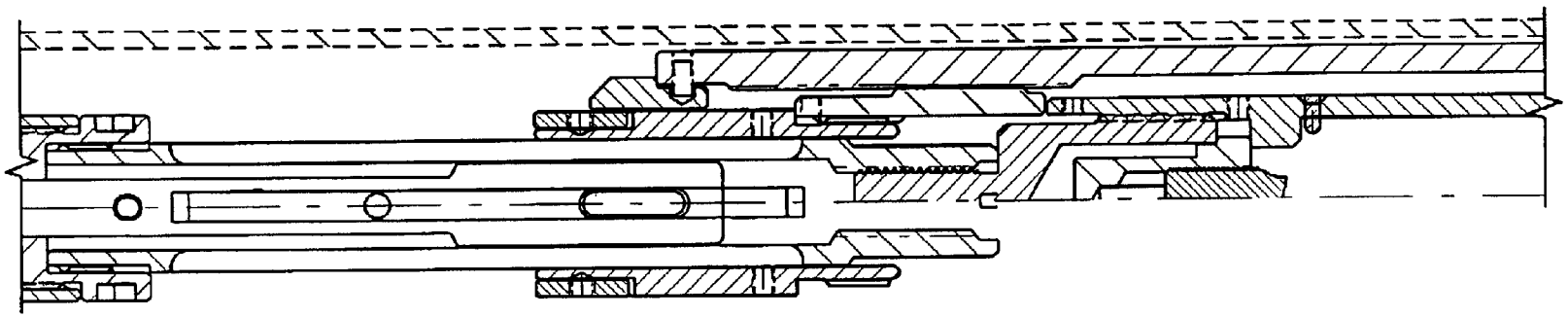

FIGS. 10*a*–10*d* and 11*a*–11*d* show a packer of known construction except that it has a narrow portion 110 in its mandrel 112. It has a sealing element 114 and slips 116 extendable with cones 118 and 120. A lock ring 122 holds the set. In the past, the packer could be released by releasing the lock ring by cutting the mandrel of the set packer downhole, as illustrated in U.S. Pat. No. 5,720,343. However this technique had its uncertainties due to doubts about placement of the cutter and knowledge as to if the cut was completed. The release technique for such packers of the present invention, removes such uncertainties. The release tool 122 can be run thru tubing on slick line or wire line and latched at latch 124. A pressure intensifier 126 of the type previously described rests on shoulder 128 of the packer or anchor P. Application of pressure from the surface or the electric line tool puts opposing forces at latch 124 and shoulder 128 until the narrow portion 110 fails in tension. This releases the hold of the set position by the lock ring 122 and allows extension and radial retraction of the slips 116 and the sealing element 114. The break 130 is shown in FIG. 11*d*. If there are multiple packers or anchors P in the well, the process can be repeated for each one that needs release. As well, the setting process can be repeated to set in any order desired, other packers or anchors P to isolate a desired zone for example. The release tool can be delivered through the production tubing or on wire line or slick line after the production tubing has been removed. After release, the release tool can drop the tool just released or it can stay with it and allow the released tool to be removed to the surface.

Other downhole tools can be expanded and extended for release in the manner described above other than packers or anchors. Some examples are screens and perforated liners.

The techniques described above will also allow for expansion and extension of a variety of tools more than a single time, should that become necessary in the life of the well. Extension of the downhole tool for release does not necessarily have to occur to the extent that failure is induced, as described in conjunction with FIGS. 10 and 11. The extension of a tool such as the packer or anchor P an embodiment of which is shown in FIG. 1, can allow it to be re-expanded with the variety of tools described above.

Tubing itself can also be expanded and extended for release using the techniques described above.

Although the retrieving tool has been illustrated as abutting a shoulder to obtain the extension, the shoulder can be provided in a variety of configurations or can be replaced with a gripping mechanism such as slips on the release tool.

The slips could alternatively replace the latching notch while still putting a downhole force on the lower shoulder. The mandrel can also have an undercut and collets can engage the undercut to put the requisite extension force on the mandrel body.

Selected zones can be isolated or opened for flow with the techniques previously described. Pressure intensifiers of various designs and pressure magnifications can be used or, alternatively, no pressure magnification device can be used.

If the through-tubing tool is used with the explosive charge as the pressure source, then it will need to be removed and the charge replenished before it is used to expand another device in the well. The hydraulically operated through-tubing tool can simply be repositioned and re-pressurized to expand another downhole packer, tubular or other tool.

The various forms of the release tools can be used with conventional packers that set with longitudinal compression of a sealing element and slips with the set held by a lock ring by extending that packer to the point of mandrel or other failure, which can release the set held by the lock ring.

Figure 14:
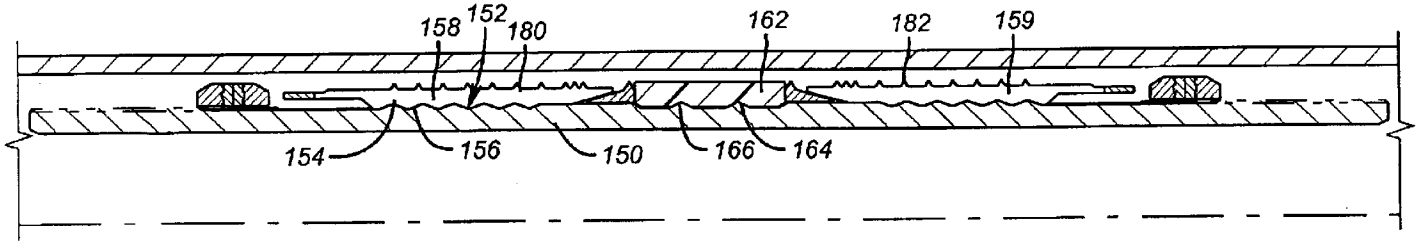
FIG. 14 is a section view during run in of a preferred embodiment showing the nodes under the sealing element and the undulating surface contact for the slips.
Figure 15:
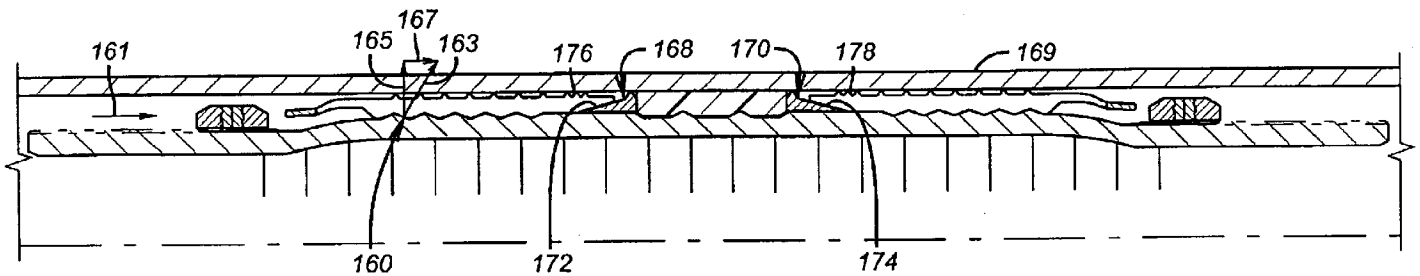
FIG. 15 is the view of FIG. 14 in the expanded and set position.

Referring now to FIG. 14, a preferred embodiment of the packer P is illustrated. The mandrel 150 has an undulating surface 152 defining peaks 154 and adjacent valleys 156. The peaks 154 and valleys 156 can be rounded, blunt or may define a sharp angle, although a slight radius is preferred. Slips 158 and 159 straddle the sealing element 162. Slips 158 and 159 each have an undulating surface 160, which matches undulating surface 152. The number and height of the undulations can be varied to meet the expected performance conditions for the packer P. Because of the slant orientation of the undulations 152 and 160 a net force from uphole acting in a downhole direction (or vice versa), represented by arrow 161 in FIG. 15, will create a radial component force acting on the slips 158 and 159 whose size depends on the size of the net force acting uphole or downhole and the angle of the mating surfaces of undulations 152 and 160. The resultant force is shown by arrow 163 and it has a radial component shown by arrow 165 and a longitudinal component shown by arrow 167.

The sealing element 162 has nodes such as 164 and 166 under it. These nodes are protrusions from the mandrel 150. They act to increase the internal pressure in the sealing element 162 so that it retains sealing contact despite load direction or load size changes. Augmenting the increase in internal seal pressure that is caused by one or more nodes such as 164 and 166 are anti-extrusion rings 168 and 170 that are mounted above and below the sealing element 162. As seen in section in FIG. 15, the rings 168 and 170 have sloping surfaces 172 and 174 respectively to engage slips 158 and 159, respectively to help push out close wickers 176 and 178. The close wickers 176 and 178 are closer to rings 168 and 170 to insure that the rings 168 and 170 are firmly positioned to prevent extrusion of element 162 despite changing loads amounts or load direction. At the same time, the internal pressure in the sealing element 162 working against rings 168 and 170 pushes their respective sloping surfaces 172 and 174 under slips 158 and 159 so as to enhance the bite of not only the close wickers 176 and 178 but also the remaining wickers 180 and 182.

Figure 16:
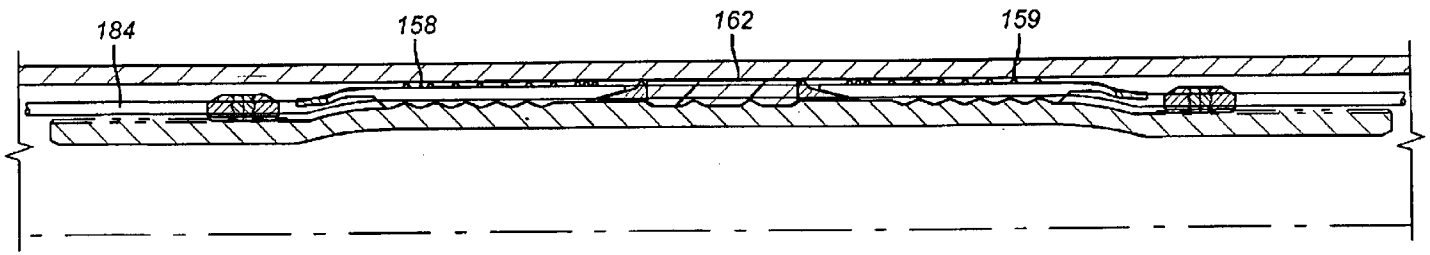
FIG. 16 is a variation of the packer shown in the set position in FIG. 15 showing a line or conductor through its body.

FIG. 16 illustrates the use of a tube or line 184 to carry signal lines or fluid pressure to locations beyond the packer P. Line 184 runs outside the mandrel 150 and through the sealing element 162 and between sets of slips such as 158 or 159. Line 184 can alternatively run through a portion of the body of mandrel 150. Fiber optic or electric lines can be run in line 184 to control downhole equipment or gather data from below the packer P.

Figure 17:
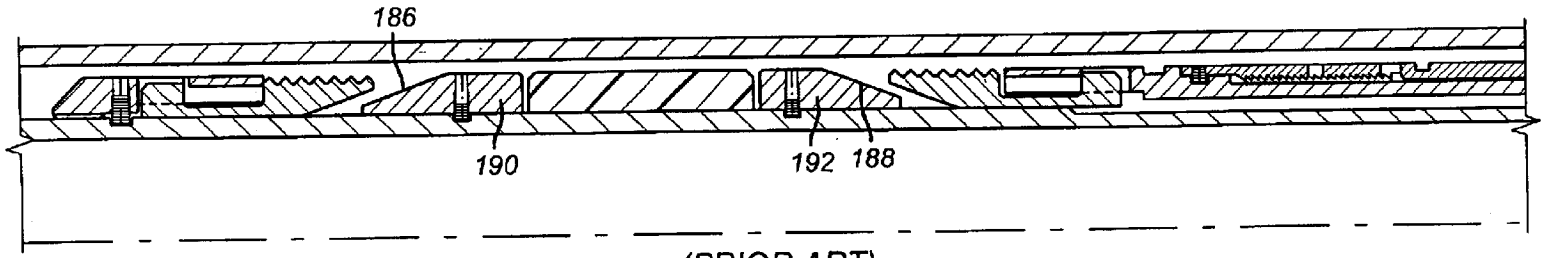
(PRIOR ART) FIG. 17
FIG. 17 is a section view of a prior art packer in the run in position showing the relatively short slip length involved, which leads to a greater stress on the surrounding tubular.
Figure 18:
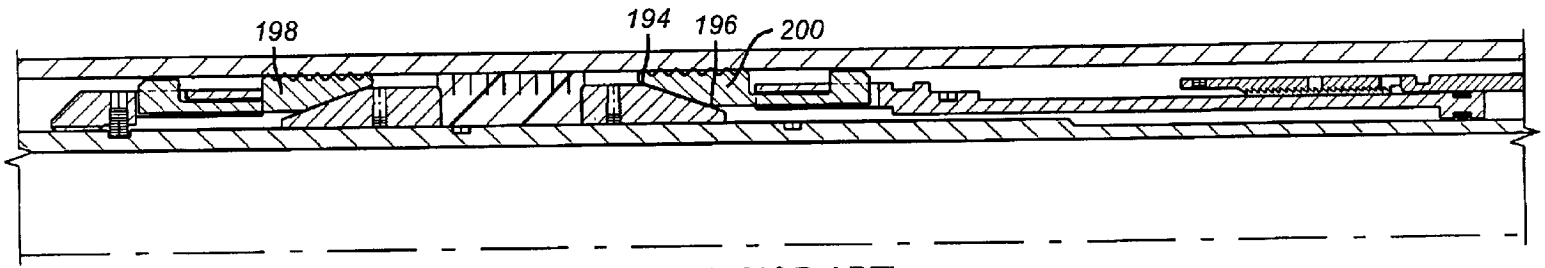
(PRIOR ART) FIG. 18
FIG. 18 is the packer in FIG. 17 in the set position.
Figure 19:
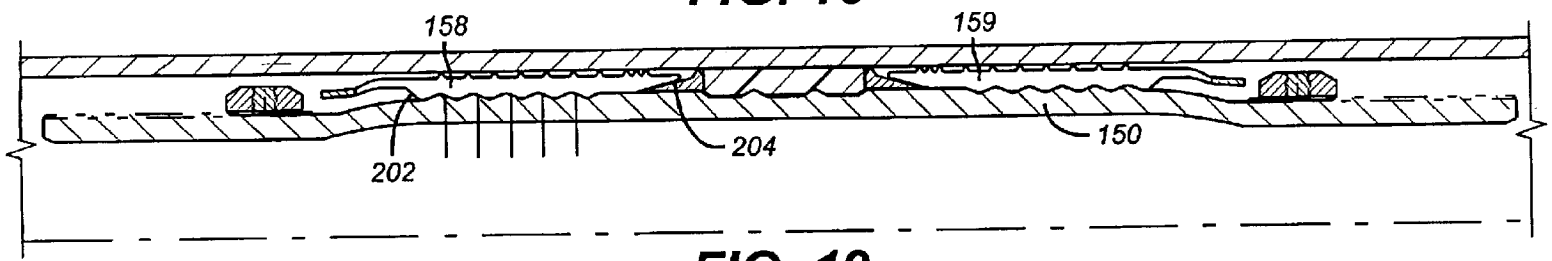
FIG. 19 is a section view in the set position of the packer of the present invention showing the longer slip lengths leading to a reduced stress on the surrounding tubular.

FIGS. 17 and 18 show the limitation of prior art systems in the ability to radially load the slips. Sloping surfaces 186 and 188 on cones 190 and 192 have limited contact with slips 198 and 200. As seen in FIG. 18 that contact is limited between points 194 and 196 of surface 188, for example. The spacing between the points 194 and 196 can't be increased because the taper angle must stay in a preferred range to transmit sufficient radial force to a slip such as 192 and making the spread between points 194 and 196 longer can effectively be done at the expense of decreasing the internal bore of the packer for a given exterior run in dimension. Accordingly, the prior art packers set by relative longitudinal movement, whether initiated by mechanical force or hydraulic pressure were limited in the length of the slips 198 and 200 to which radial loading could be applied. This limitation forced higher stresses to be applied to the tubular against which the slips 198 and 200 were actuated. The packer P of the present invention solves this problem using the expansion technique. As shown in FIG. 19, mandrel 150 expands below a slip such as 158 by applying a radial force between points 202 and 204, with point 204 being on surface 172 of ring 168. This spacing between points 202 and 204 can be as long as desired and much longer than the design parameters of the prior art designs illustrated in FIGS. 17 and 18 would allow. As a result, the desired contact force is applied over a substantially grater contact area, extending to a substantial portion of the length of longer slips, to greatly reduce the stress applied to the surrounding tubular or the formation if in open hole. As previously stated, in a cased hole, for example, the surrounding tubular need not be deformed as the wickers such as 176–182 dig in for a bite. The present invention allows for the use of more wickers to decrease the stress on the tubular from the penetration. Even if all the wickers bottom into the surrounding tubular, the resulting stress is reduced, when compared to the prior art, because the contact area over which radial force is transmitted has been dramatically increased. The radial load can be applied to over 90% of the length of the slips that can be used in any desired length.

Figure 22:
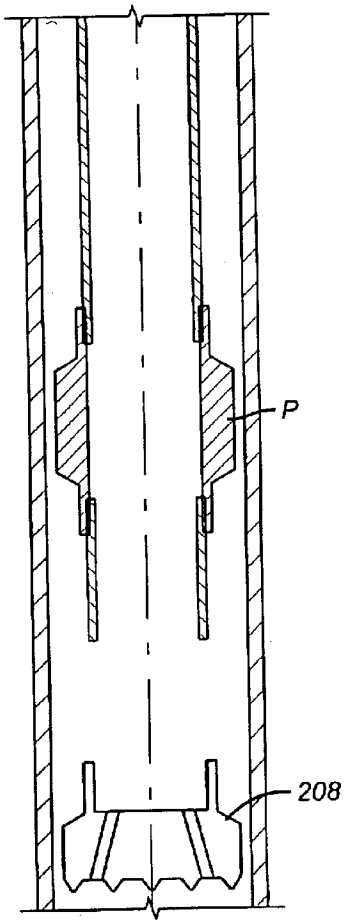
FIG. 22 is the view of FIG. 21 after the bit is released.
Figure 21:
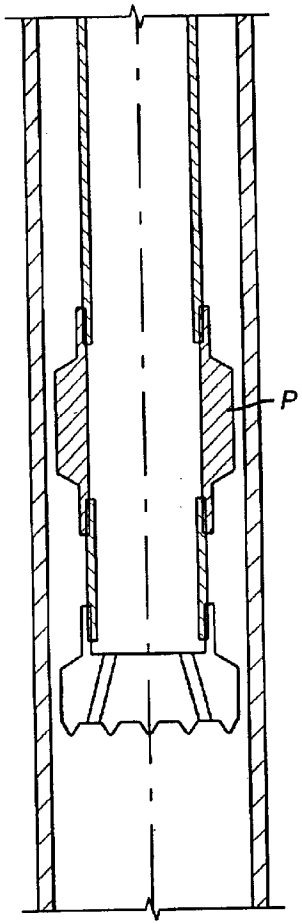
FIG. 21 is the view of FIG. 20 after the plug is drilled out.
Figure 20:
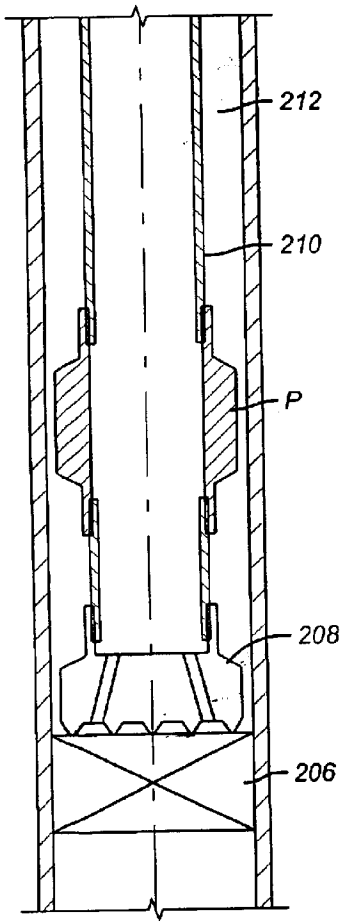
FIG. 20 shows the use of the packer of the present invention when drilling out a plug.
Figure 23:
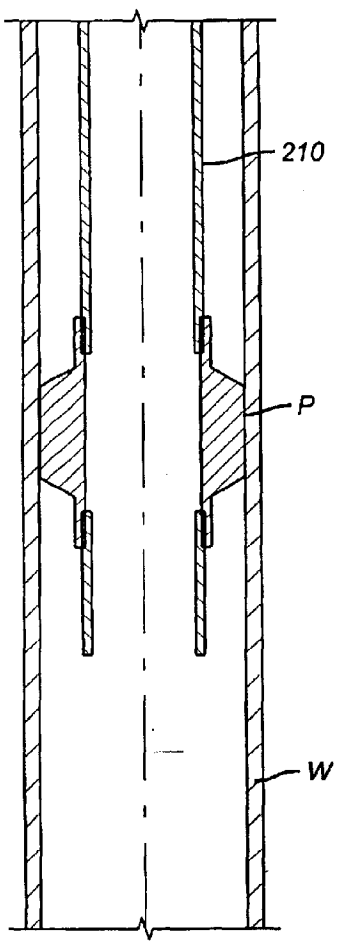
FIG. 23 is the view of FIG. 22 with the packer expanded to the set position.

FIGS. 20–23 show an application of the packer P to drilling out a well plug 206 with a bit 208, with the packer P mounted right above on the drill string 210. After the plug is drilled out the annulus 212 can be isolated when the packer P is expanded. In FIG. 21, the plug 206 is fully milled out. In FIG. 22, the bit 208 is released. In FIG. 23, the packer P is expanded into contact with the wellbore W, isolating the annulus 212 around the drill string 210. Production can start through string 210 with the annulus 212 sealed off by packer P. The advantage is the robustness of the packer to allow cuttings to be circulated around it. The prior art technique dispensed with annulus isolation and allowed communication into annulus 212 as the well was produced into string 210. In gas wells, potentially corrosive gasses could migrate into the annulus damaging the wellbore W, which could be casing of a material incompatible with the migrating gas. Even circulating or reverse circulating mud of a predetermined weight into the annulus, in the past, without annulus isolation, did not insure that undesirable fluids would not migrate into the annular space. The packer P of the present invention can be used to provide positive annulus isolation in such applications, as illustrated in FIGS. 20–23.

Figure 24:
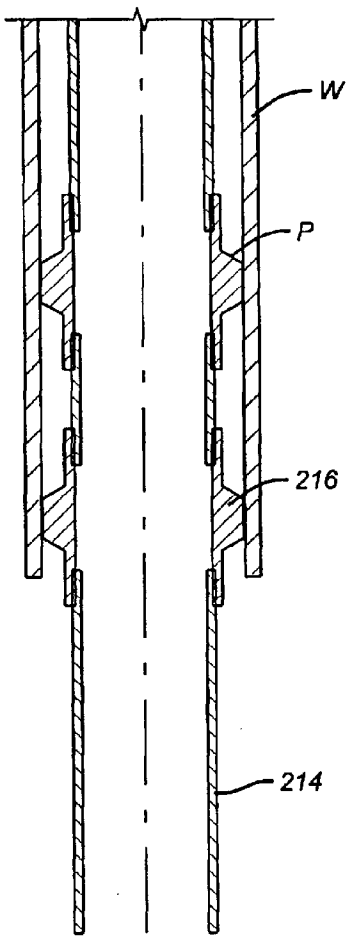
FIG. 24 is a section view of an application of the packer of the present invention to a liner top isolation packer next to a liner hanger.

FIG. 24 illustrates a liner 214 suspended from a liner hanger 216 with the packer P serving as the liner top packer in wellbore W, which can be cased or uncased.

FIGS. 25–28 illustrate the use of the packer P initially as an isolation packer and subsequently as a production packer.

Figure 25:
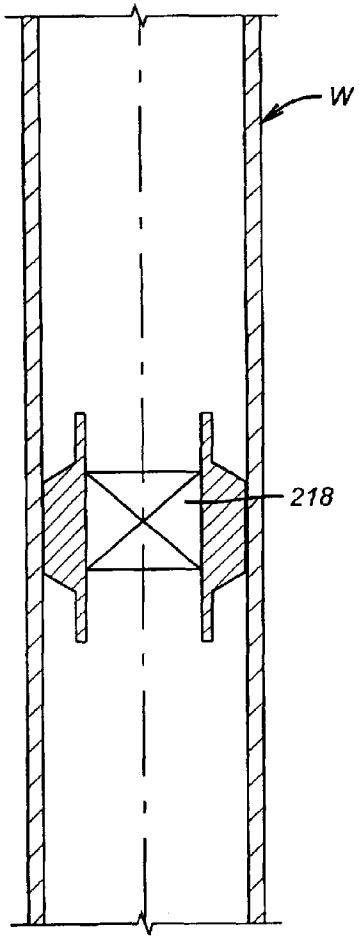
FIG. 25 shows a set packer having an interior plug.
Figure 28:
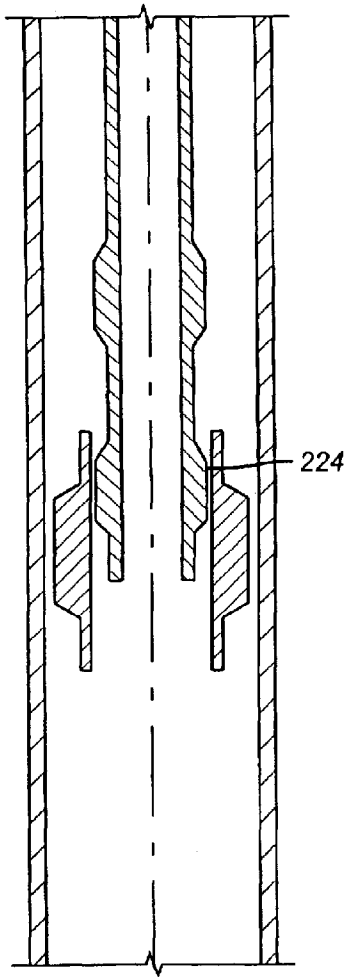
FIG. 28 shows the retrieving tool releasing the packer by stretching it.
Figure 27:
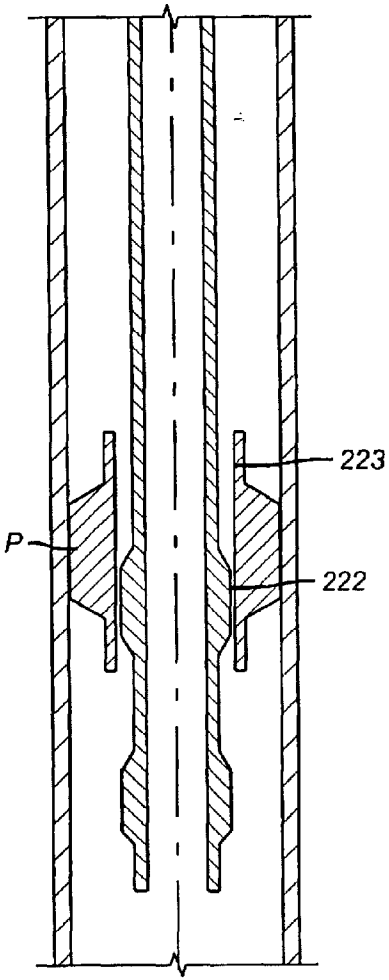
FIG. 27 shows the plug being knocked out and the seals landed in the packer.
Figure 26:
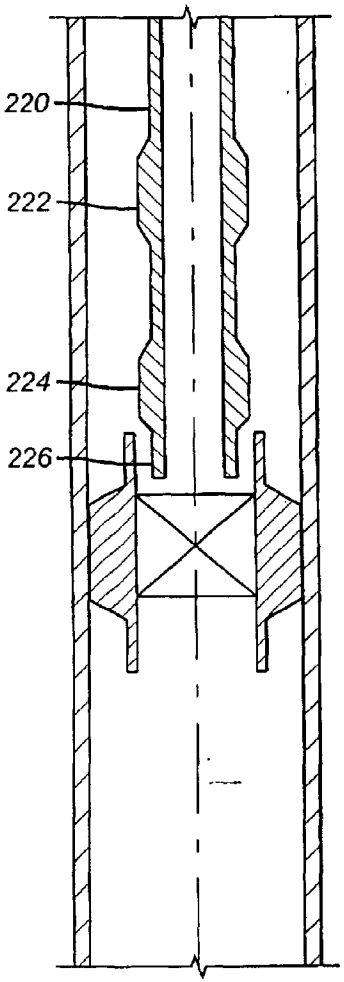
FIG. 26 is the view of FIG. 25 showing running in with a string with a seal, a retrieving tool and a sinker bar.
Figure 29A:
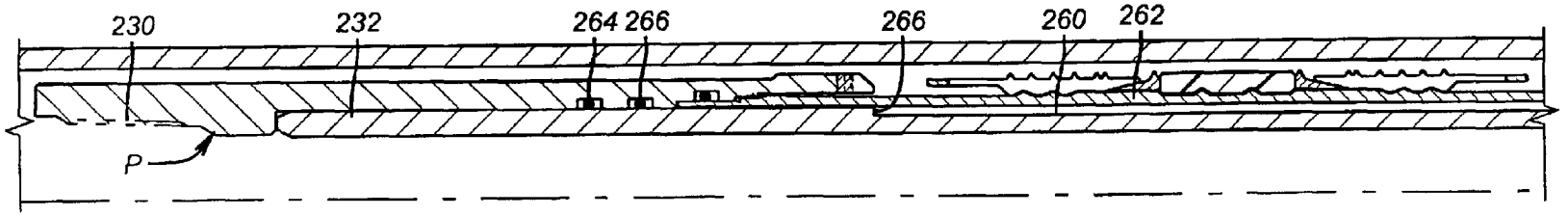
FIGS. 29*a*–*b* are a section view of a one-trip packer with pressure intensifier in the run in position.
Figure 30A:
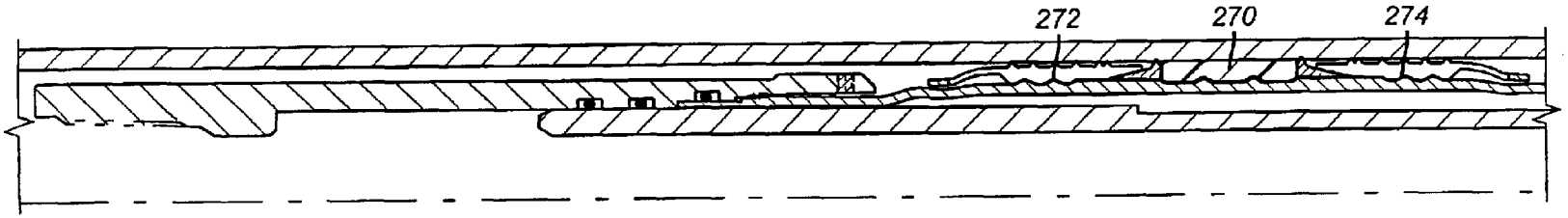
FIGS. 30*a*–30*b* are the packer of FIGS. 29*a*–29*b* in the set position.
Figure 31A:
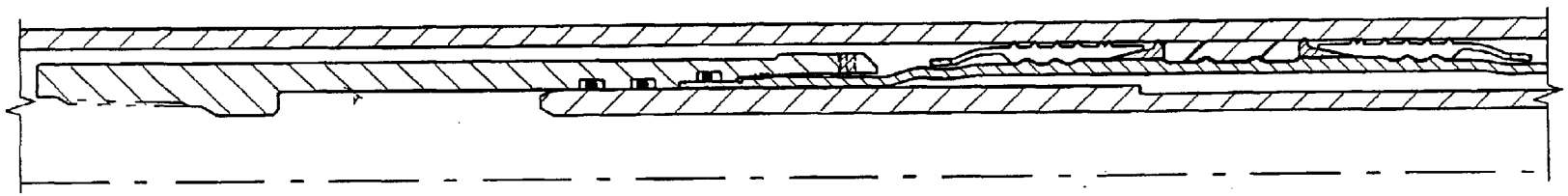
FIGS. 31*a*–31*b* are the packer of FIGS. 30*a*–30*b* shown in the ball released position.
Figure 29B:
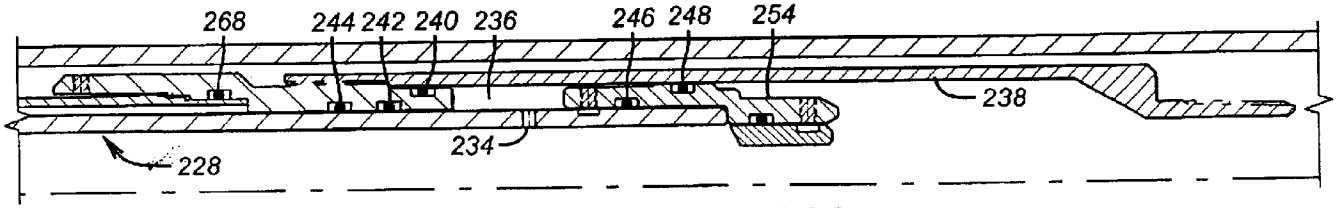
Figure 30B:
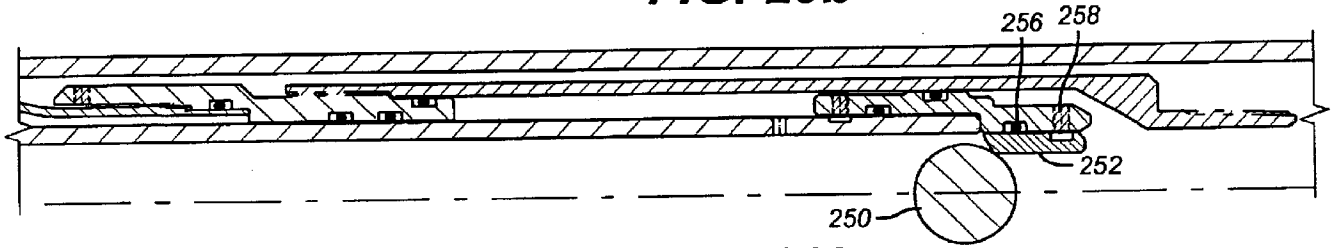
Figure 31B:
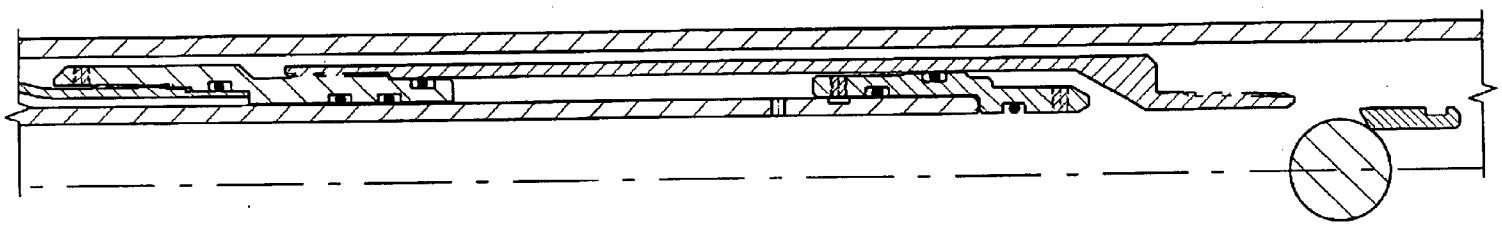

As shown in FIG. 25, the packer P is expanded into a sealing position. The packer P is shown schematically. It may have a removable plug 218 that sits below its body. Plug 218 can be run in with the packer P and portions of the packer above the plug 218 can be expanded into sealing position with the wellbore W. As shown in FIG. 26, an assembly comprising of tubing 220, seal assembly 222, retrieving device 224, and a sinker bar 226 are lowered into position adjacent the plug 218. In FIG. 27, the plug 218 has been knocked out and the seal assembly 222 is in seal bore 223 of the packer P. FIG. 28 illustrates the release tool and retrieving device 224, as previously described, stretching the packer P to get it to release and retaining a grip on it after release so it can be removed.

Figure 32:
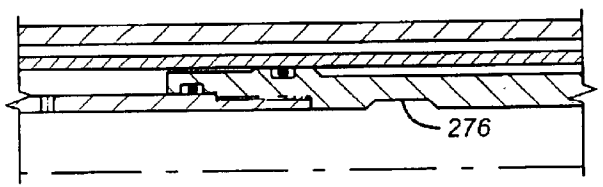
FIG. 32 shows a latching grove for a slick line plug used as an alternative to setting the packer.

FIGS. 29–32 illustrate a one trip hydraulically set packer P that is run in and set using a pressure intensifier 228. Mounted inside body 230 is a piston 232. A port 234 communicated into annular space 236 defined by lower sub 238. Seals 240–248 isolate annular space 236 so that applied pressure after ball 250 lands on seat 252 puts a downward force on piston 232, which moves in tandem with sleeve 254. Seal 256 allows pressure to be built up on landed ball 250 until a predetermined value, at which point the shear pin or pins 258 break to release ball 250, as shown in FIG. 31*b*. As shown in FIG. 29*a*, annular space 260 is defined between piston 232 and mandrel 262. Seals 264–268 and 240–244 isolate the annular space 260. Piston 232 has a shoulder 266, which decreases the volume of annular space 260 as the piston 232 is moved downwardly. The pressure is intensified because the radius of seal 248 is larger than the radius of seals 242–244 and 264–266. The downward force on ring 254 is converted to a greater force applied to a smaller radius, where shoulder 266 is located. As a result, the mandrel 262 expands radially to push out the sealing element 270 and the slips 272–274 in the manner previously described. After the packer P is set, a further buildup of pressure on ball 250 breaks shear pin 258 to release ball 250 downhole. FIG. 32 shows an alternative way to set the packer P using a slick line plug, not shown, that lands in groove 276 and seals adjacently using seals carried on the plug. The packer P is then set using the pressure intensification as described with respect to FIGS. 29–31. At the conclusion of the setting process, the plug is captured with a fishing tool on a fishing neck, in a known manner and hoisted out. No matter how the packer is set, the intensifier 228 is built into it and stays in position after the packer P is set to become a part of the central passage through the packer P. The packer P is run in on one trip and pressured up after the object such as ball 250 or a slick line plug (not shown) is quickly placed in position to allow pressure buildup to initiate expansion. If using the slickline plug, multiple packers can be run on a single string and set in a predetermined order or in any random order.

Figure 33A:
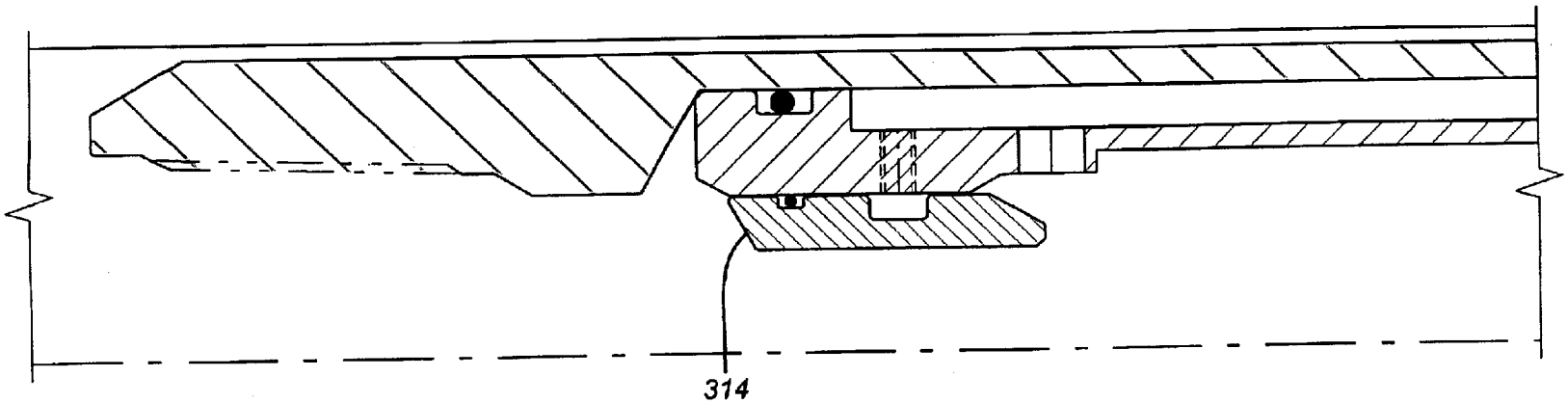
FIGS. 33*a*–33*e* is an alternative embodiment showing an internal recess on the slips against a cylindrical expansion mandrel, in the run in position.
Figure 33B:
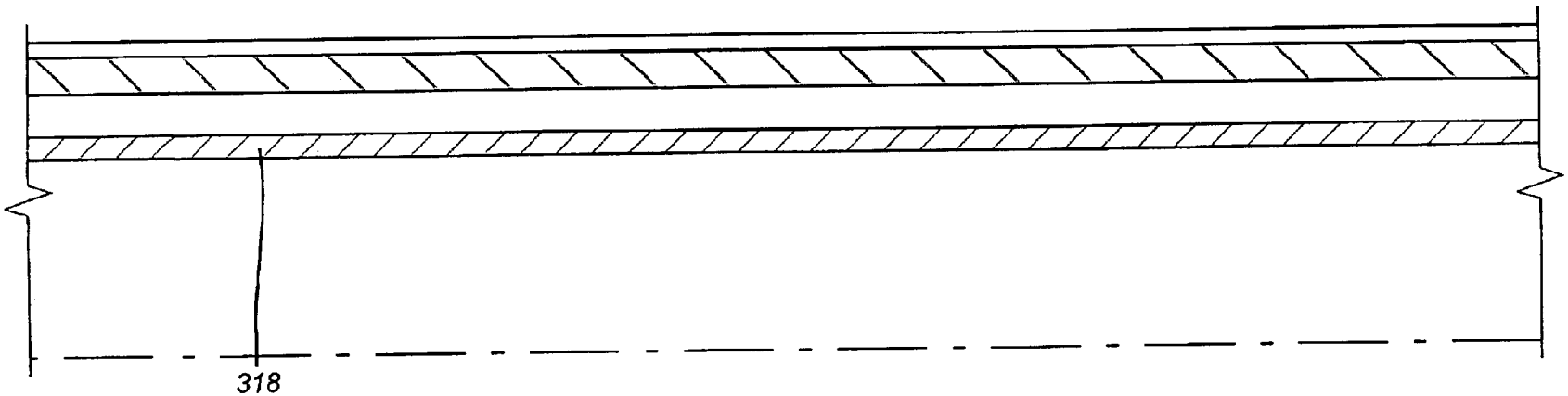
Figure 33C:
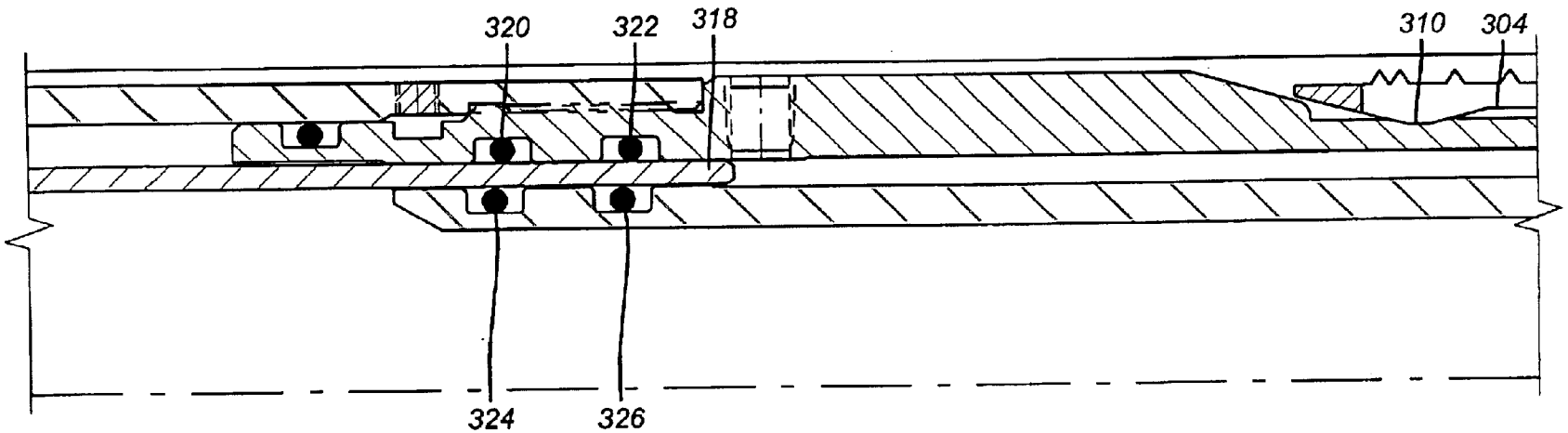
Figure 33D:
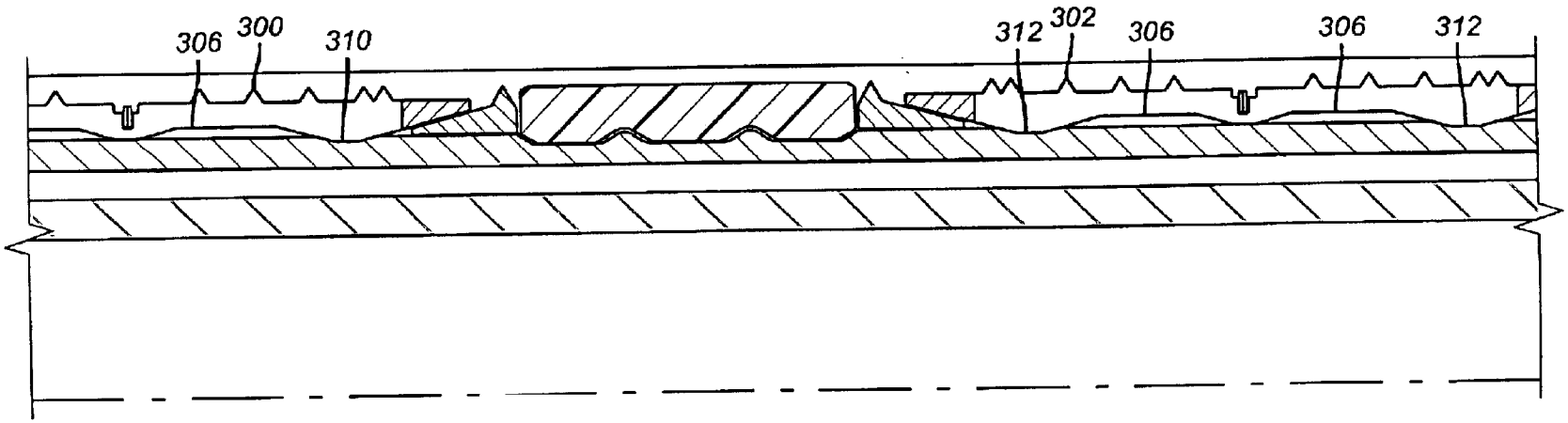
Figure 33E:
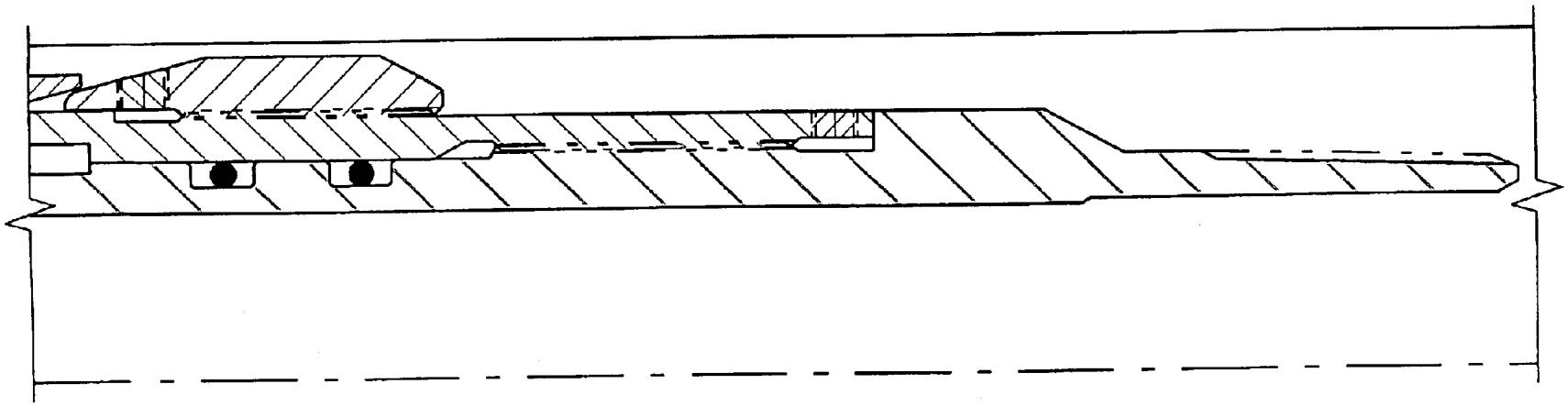
Figure 34A:
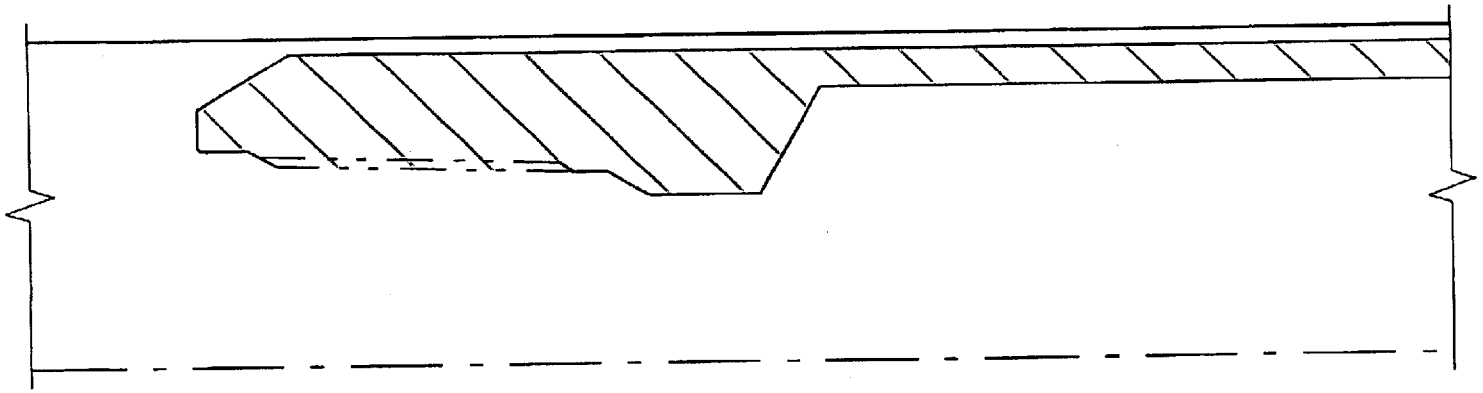
FIGS. 34*a*–34*e* are the view of FIGS. 33*a*–33*e* in the set position.
Figure 35A:
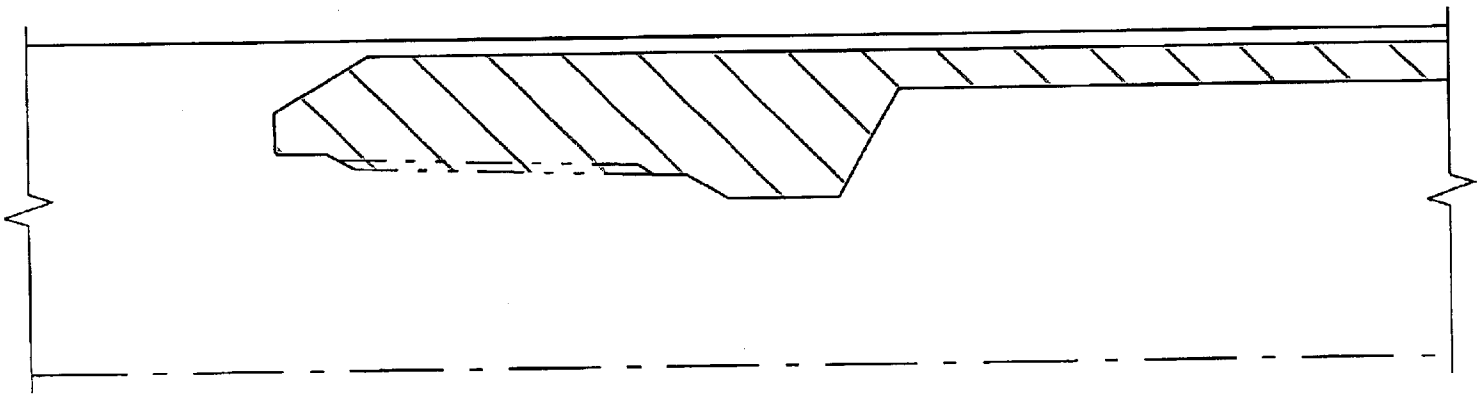
FIGS. 35*a*–35*f* are the view FIGS. 34*a*–34*e* in the ball release position.
Figure 34B:
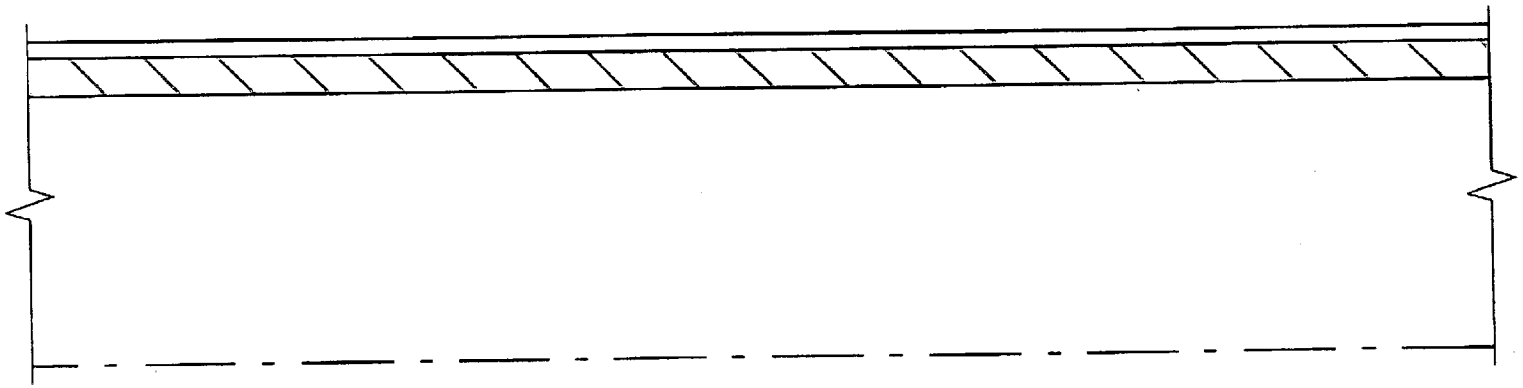
Figure 35B:
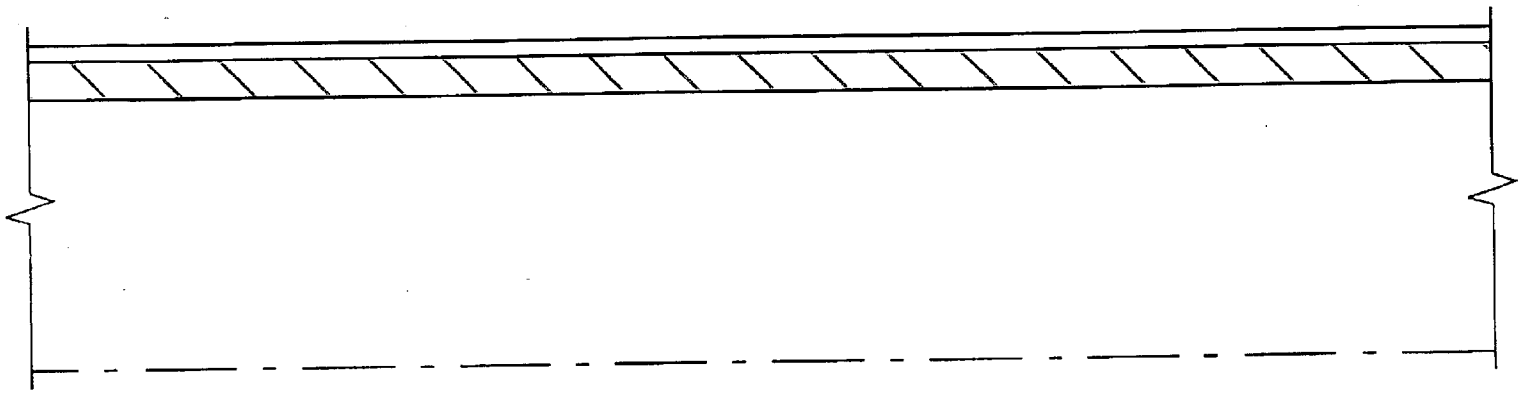
Figure 34C:
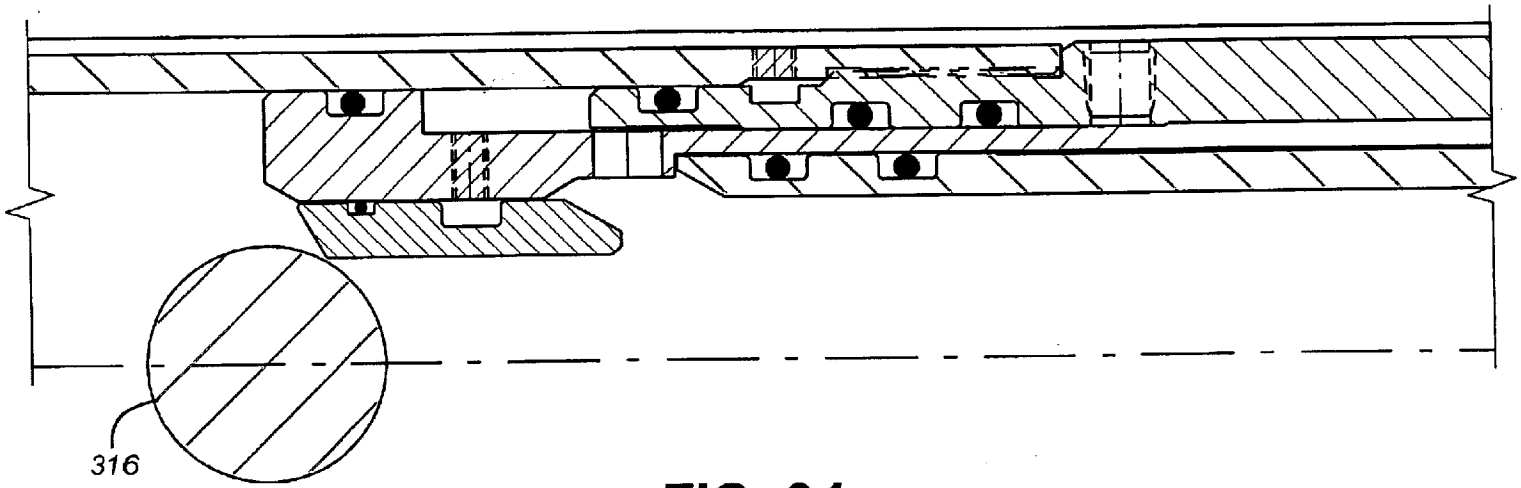
Figure 35C:
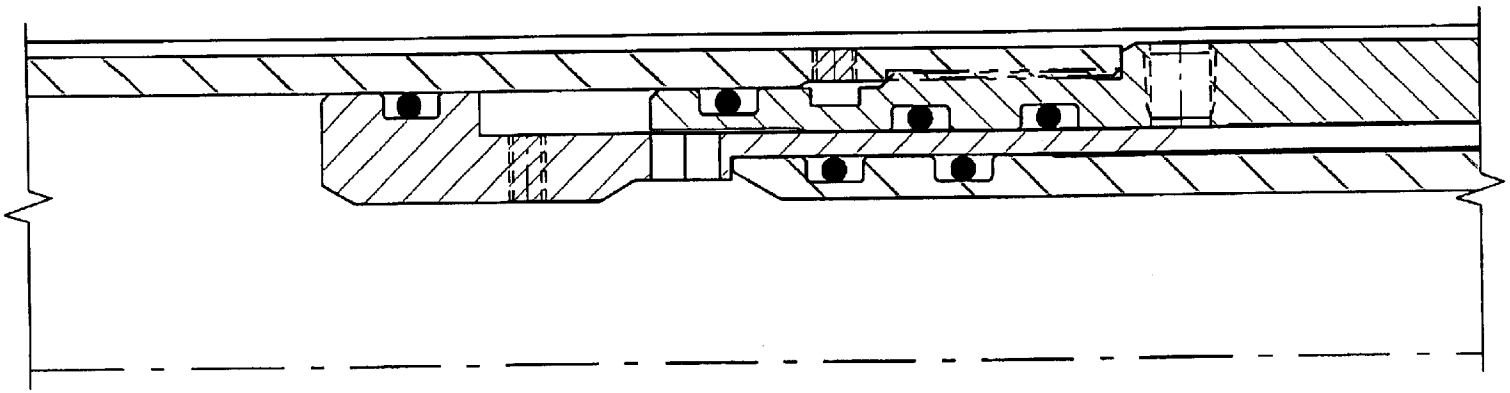
Figure 34D:
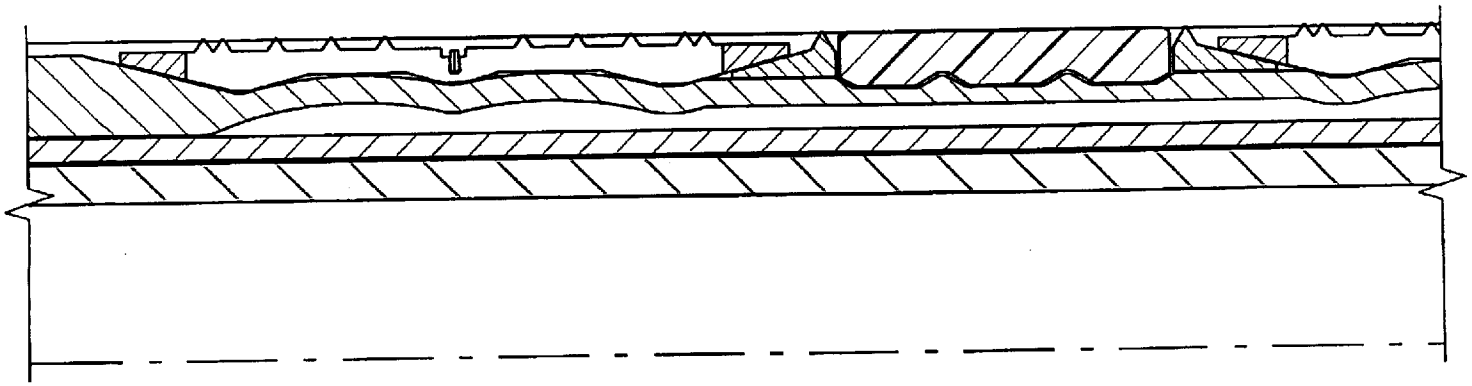
Figure 35D:
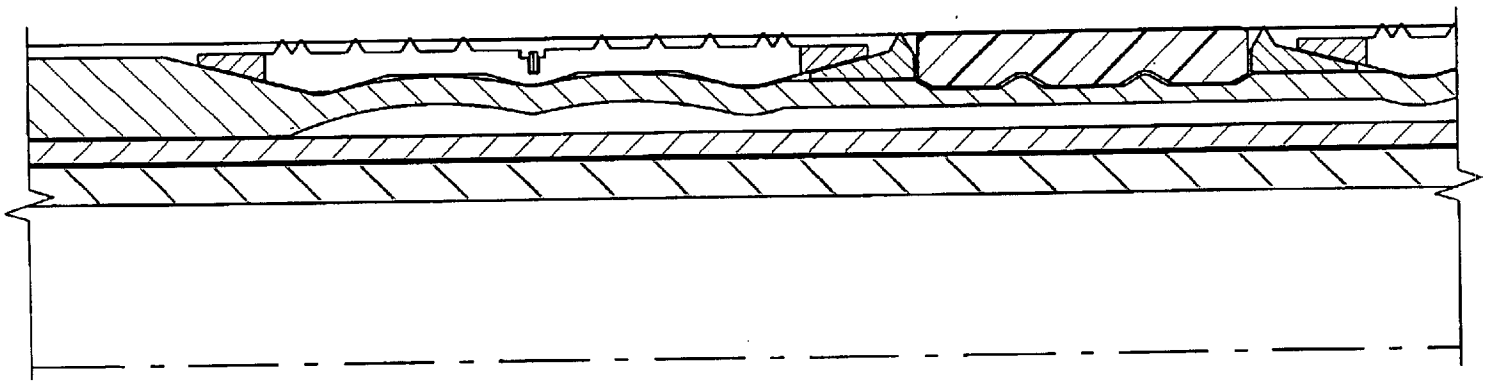
Figure 34E:
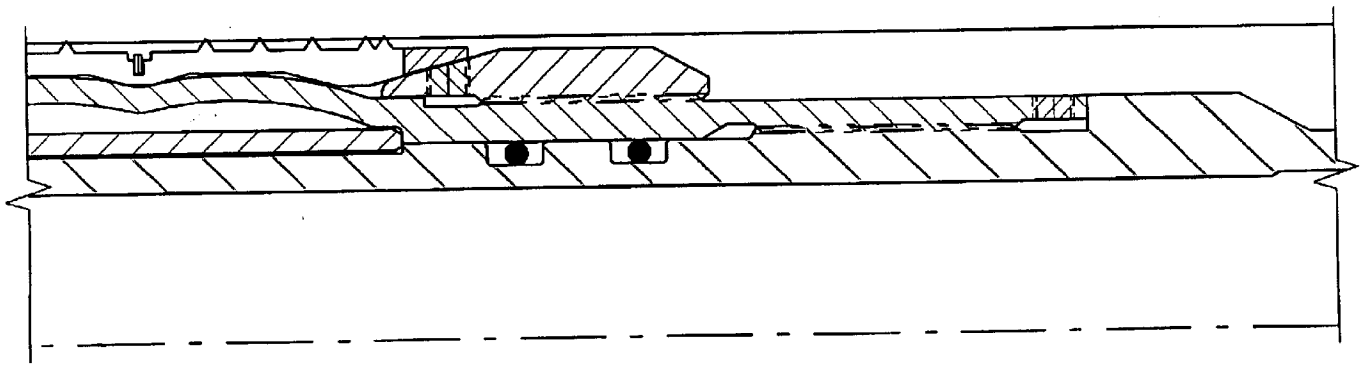
Figure 35E:
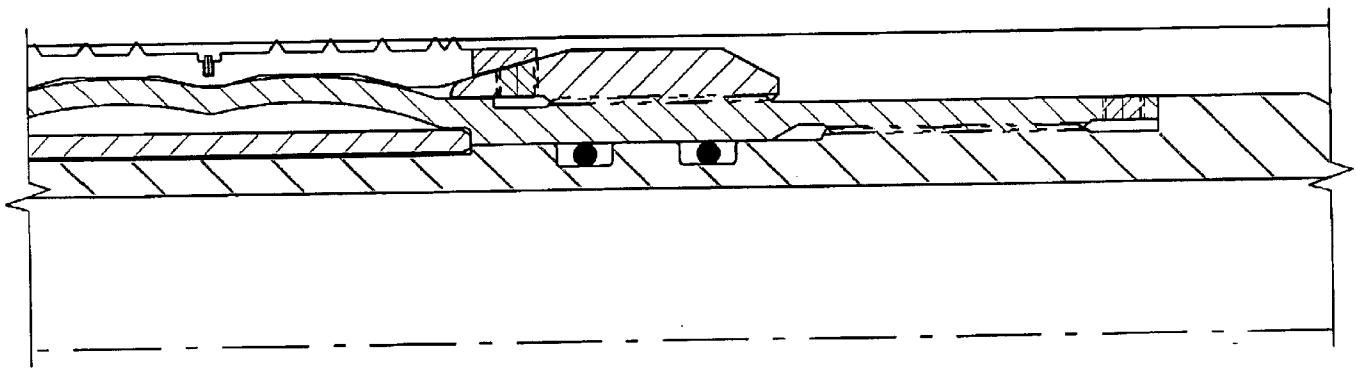
Figure 35F:
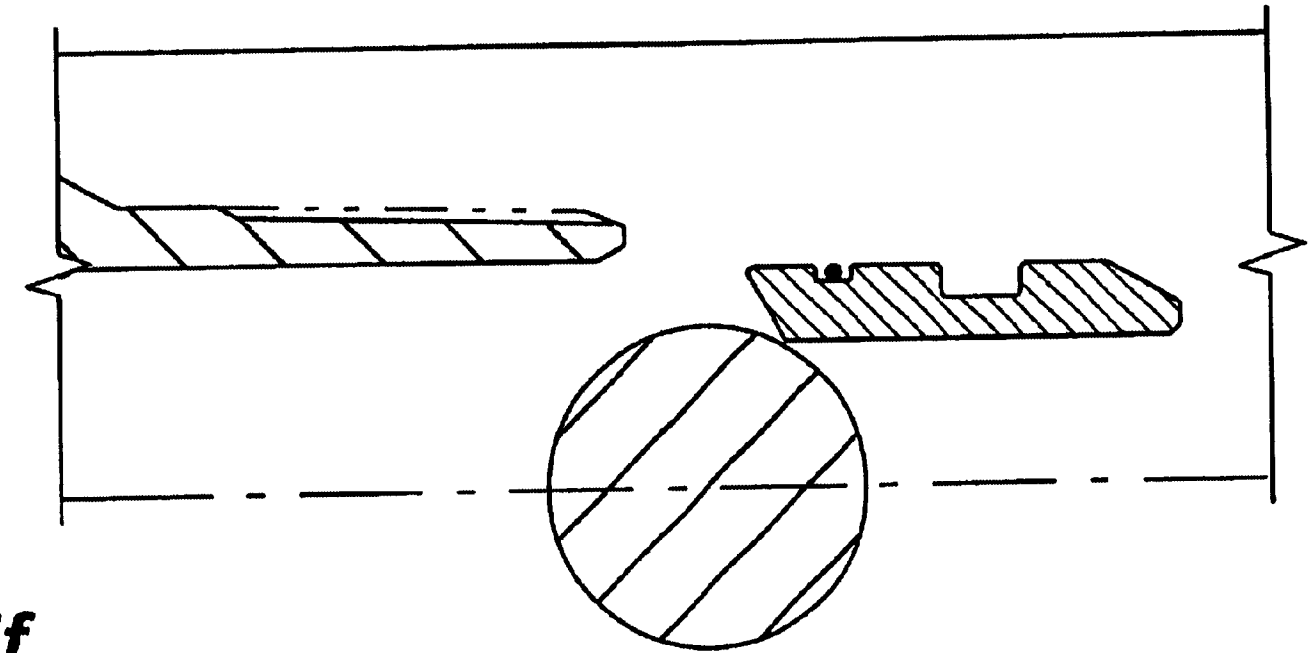

Referring to FIGS. 33*a*–33*e*, an alternative embodiment is disclosed. The slips 300 and 302 now each have at least one inwardly oriented depression 304 and 306 respectively. The expansion mandrel 308 is preferably cylindrical in the region of slips 300 and 302 but may have slight indentations 310 and 312 to orient the slips 300 and 302 in the run in position. As shown in FIG. 33*a*, a seat 314 accepts a ball 316 for movement of the piston 318. Piston 318 moves between outer seals 320 and 322 and inner seals 324 and 326 to reduce the volume of cavity 328. Because the area of cavity 328 is smaller than the piston area at seat 314 with ball 316 landed on it, there is a magnification of applied pressure on the ball 316 that acts to expand the expansion mandrel 308. FIGS. 34*d*–34*e* show what happens as the expansion mandrel 308 expands. It not only pushes the slips 300 and 302 outwardly to make supporting contact with the wellbore or tubular 330 but it also assumes the interior shape of the slips 300 and 302 by expanding into their respective depressions 304 and 306. Those skilled in the art will appreciate that the depressions 304 and 306 may be on the mandrel 308 and that slips 300 and 302 can be cylindrical or have outward projections on their inwardly oriented surfaces. The advantage to the embodiment in the FIGS. 33–35 is that it is simpler to put recesses 304 and 306 into the slips than to prepare an expansion mandrel and matching slips with mating undulating surfaces. Since there is some shrinkage in length during the expansion process, getting the undulations to stay meshed throughout the expansion process can become an issue. Using the preferred embodiment of a depression on the slips not only better secures the slips 300 and 302 to the expansion mandrel 308 but it takes better advantage of the shrinkage during expansion to hold the slips 300 and 302 in position. The number, shape and depth of depressions 304 and 306, as well as their location on the slips or the expansion mandrel can be varied depending on the application. FIG. 35*f* shows the seat 314 and the ball 316 being blown out of the way after the set position is obtained. A plug or some other object can be used instead of ball 316 to temporarily obstruct the interior passage to allow pressure buildup to set the Packer P.

Apart from reducing stress on a surrounding tubular or wellbore, the packer P of the present invention also conforms to oval shaped casing as well as provides increased collapse resistance in the set position. The packer P can be delivered into casing on wireline or slickline or on wireline or slickline through tubing. Alternatively coiled tubing can deliver the packer P into casing or through tubing. The packer P can be set hydraulically in one trip as described or in two trips when combined with an intensifier that needs to be removed after expansion. The retrieving tool for the packer P can be delivered into the packer P in the variety of ways the packer P can be delivered. The release tool preferably stretch the packer P sufficiently until it releases and can be combined with a pressure intensifier. The releasing can be done with one trip or additional trips. The packer P can be used in a variety of applications apart from those described in detail above. Some examples are frac/injection, production, feed through, dual bore, zone isolation, anchored seal bore, floating seal bore, Edge set, combined with sliding sleeve valves, and setting in a multilateral junction.

The simplicity of the packer P lends itself to rapid development with less testing than other prior art designs because its behavior under expansion forces is more predictable. Prior art packers were compressed axially to expand radially and had many parts that moved relatively to one another. It was difficult to predict how the seal would react to an axial compressive force. As a result complex programs were developed to predict seal behavior under compressive force. With the packer P on the other hand, the reaction of the seal to expansion is more readily predicted. Additionally, prior designs required a variety of anti-extrusion systems and those needed testing to see that they would deploy before extrusion had actually taken place. With the packer P scaling up from one size to another is also simplified.

The packers P can be introduced quickly at different levels in the wellbore and set or released selectively with ease. In another application the packer P can be run in on tubing and then pumping cement through the tubing and out around the packer, followed by setting the packer. The packer P can be used as a velocity string hanger below a safety valve. The packer P can have multiple bores and it can be set in not only out of round casing but also in the reformed leg of a multilateral junction. The packer P either assumes the oval shape or conforms the oval tubing back to a round shape. The expansion technique enhances not only collapse resistance but also corrosion resistance. The reason is that by using a swage to expand, higher stresses are imposed than if pressure is used, with the result being a loss in corrosion resistance and collapse resistance. As an alternate to release by stretching, release can be accomplished by isolation of the expanded segment and pulling a vacuum to collapse the mandrel sufficiently so that it will release for removal.

The rings 168 and 170 keep the wickers 176–182 engaged despite reversals in load direction. Internal pressure in the sealing element 162 creates a radial force on the slips 158 and 159 through the ramped surfaces on rings 168 and 170. The nodes 164–166 allow the use of a non-elastomeric seal. Pressure one end of seal element 162 transfers load to another node on the lower pressure end of the seal element 162. The presence of multiple nodes increases the internal pressure to help maintain the seal as loading conditions shift.

Another distinction from the prior art packers is the use of even loaded collet type slips that are urged into greater contact with the casing when uphole or downhole pressures increase. Due to the undulating contact between the slips and the mandrel, such axial loading from pressure is not transmitted to the sealing element; rather it just causes the slips to grab harder.

The above description is illustrative of the preferred embodiment and many modifications may be made by those skilled in the art without departing from the invention whose scope is to be determined from the literal and equivalent scope of the claims below.

We claim:

1. An expandable packer for sealing a wellbore, comprising:

an expandable mandrel said mandrel comprising an innermost tubular of the packer and further comprising a passage therein, said mandrel movable radially outwardly by an applied force from within said passage from a run in position to a set position;

a sealing element mounted to said mandrel, said mandrel comprises at least one surface irregularity under said sealing element for increasing the internal pressure of said sealing element by remaining under said sealing element when said mandrel is moved toward said set position.

2. The packer of claim 1, wherein:

said surface irregularity comprises at least one projection on the mandrel that digs into the sealing element when said mandrel is in said set position.

3. The packer of claim 2, wherein:

said projection increases the internal pressure in said sealing element when said mandrel is in said set position.

4. The packer of claim 1, wherein:

said surface irregularity comprises at least one depression on the mandrel that allows said sealing element to engage the mandrel as said sealing element is forced into said depression when said mandrel is in said set position.

5. An expandable packer for sealing a wellbore, comprising:

an expandable mandrel movable radially outwardly by an applied force from a run in position to a set position;

a sealing element mounted to said mandrel, said mandrel comprises at least one surface irregularity in contact with said sealing element;

at least one slip mounted to said mandrel;

said slip is retained to said mandrel by virtue of at least one surface irregularity on at least one of said mandrel and said slip.

6. The packer of claim 5, wherein:

said slip comprises a surface irregularity and said mandrel conforms to the shape of said surface irregularity on said slip when in its said set position.

7. The packer of claim 5, wherein:

said slip and said mandrel both comprise surface irregularities that conform to each other in the run in position of said mandrel.

8. The packer of claim 7, wherein:

said surface irregularities comprise matching undulating surfaces.

9. The packer of claim 5, wherein:

shrinkage of said mandrel as it is forced to said set position in the region of said surface irregularity enhances the grip between the wellbore and said slip.

10. The packer of claim 5, wherein:

said surface irregularity creates a radial component of force into said slip into contact with the wellbore in response to an uphole or downhole directed force on said mandrel with said mandrel in said set position.

11. An expandable packer for sealing a wellbore, comprising:

an expandable mandrel movable radially outwardly by an applied force from a run in position to a set position;

a sealing element mounted to said mandrel, said mandrel comprises at least one surface irregularity in contact with said sealing element;

at least one slip mounted to said mandrel;

at least one anti-extrusion ring mounted to said mandrel adjacent said sealing element, said anti-extrusion ring mounted in contact with said slip.

12. The packer of claim 11, wherein:

said slip contacts said ring in a manner that provides a wedging of said ring toward said sealing element.

13. The packer of claim 12, wherein:

said ring contacts said slip by way of contacting sloping surfaces such that movement of said mandrel to said set position creates a reaction force through said slip and said sloping surfaces to urge said ring toward said sealing element.

14. The packer of claim 13, wherein:

said sloping surfaces create a longitudinal component of force, acting in the direction of the wellbore, on said sealing element.

15. The packer of claim 11, wherein:

said ring has a generally triangular cross-section when taken in alignment with the wellbore.

16. An expandable packer for sealing a wellbore, comprising:

an expandable mandrel movable radially outwardly by an applied force from a run in position to a set position:

at least one slip mounted to said mandrel;

a sealing element mounted to said mandrel;

at least one anti-extrusion ring mounted to said mandrel adjacent said sealing element, said anti-extrusion ring mounted in contact with said slip.

17. The packer of claim 16, wherein:

said slip contacts said ring in a manner that provides a wedging of said ring toward said sealing element.

18. The packer of claim 17, wherein:

said ring contacts said slip by way of contacting sloping surfaces such that movement of said mandrel to said set position creates a reaction force through said slip and said sloping surfaces to urge said ring toward said sealing element.

19. The packer of claim 18, wherein:

said sloping surfaces create a longitudinal component of force, acting in the direction of the wellbore, on said sealing element.

20. The packer of claim 16, wherein:

said ring has a generally triangular cross-section when taken in alignment with the wellbore.

21. The packer of claim 16, wherein:

said slip is retained to said mandrel by virtue of at least one surface irregularity on at least one of said mandrel and said slip.

22. The packer of claim 21, wherein:

said mandrel comprises at least one surface irregularity in contact with said sealing element.

23. The packer of claim 16, wherein:

force transmitted to the anti-extrusion ring from the sealing element enhances the grip between the slip and the well bore.

24. The packer of claim 16, wherein:

said slip comprises a first end closer to said anti-extrusion ring and a plurality of wickers thereon, said wickers being more closely spaced near said first end.

* * * * *